US008882254B2

(12) United States Patent
Von Essen et al.

(10) Patent No.: US 8,882,254 B2
(45) Date of Patent: Nov. 11, 2014

(54) SYSTEMS AND METHODS FOR DELIVERING AND RECIRCULATING FLUIDS

(75) Inventors: Kevin Von Essen, San Jose, CA (US); John A. Higginson, Santa Clara, CA (US); Paul A. Hoisington, Hanover, NH (US); Don S. Minami, Monte Sereno, CA (US)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 13/463,353

(22) Filed: May 3, 2012

(65) Prior Publication Data

US 2013/0293642 A1 Nov. 7, 2013

(51) Int. Cl.
*B41J 2/175* (2006.01)

(52) U.S. Cl.
USPC ..... 347/93; 347/92

(58) Field of Classification Search
CPC ..... B41J 2/17563; B41J 2/19
USPC ..... 347/92, 93, 85, 86, 87
See application file for complete search history.

(56) References Cited

U.S. PATENT DOCUMENTS

| | | | | |
|---|---|---|---|---|
| 4,319,996 | A * | 3/1982 | Vincent et al. | 210/188 |
| 5,546,109 | A * | 8/1996 | Nakano | 347/93 |
| 5,724,082 | A * | 3/1998 | Moynihan | 347/88 |
| 6,120,140 | A * | 9/2000 | Hirosawa et al. | 347/93 |
| 6,457,821 | B1 | 10/2002 | Liu et al. | |
| 6,520,632 | B1 | 2/2003 | Yamazaki et al. | |
| 6,588,891 | B1 | 7/2003 | Steven et al. | |
| 6,955,426 | B2 * | 10/2005 | Kaga et al. | 347/92 |
| 7,182,449 | B2 | 2/2007 | Inoue | |
| 7,481,593 | B2 * | 1/2009 | Kwan et al. | 401/270 |
| 7,585,063 | B2 * | 9/2009 | Okuda | 347/86 |
| 7,595,196 | B2 * | 9/2009 | Guo et al. | 436/163 |
| 7,604,337 | B2 | 10/2009 | Koseki | |
| 2002/0057320 | A1 * | 5/2002 | Kaga et al. | 347/92 |
| 2004/0125179 | A1 * | 7/2004 | Watanabe | 347/85 |
| 2005/0036017 | A1 * | 2/2005 | Chikamoto et al. | 347/93 |
| 2005/0117003 | A1 * | 6/2005 | Kyogoku et al. | 347/86 |
| 2007/0109365 | A1 * | 5/2007 | Okuda | 347/85 |

(Continued)

OTHER PUBLICATIONS

"Common Metal Mesh Configuration, Dutch Weaves" Sefar North America, 2 pgs. (2009).

*Primary Examiner* — Matthew Luu
*Assistant Examiner* — Patrick King
(74) *Attorney, Agent, or Firm* — Fish & Richardson P.C.

(57) ABSTRACT

Among other things, a device for use in printing is described. The device comprises a first chamber for receiving a liquid and a first filter member in the first chamber. The first filter member separates the first chamber into a first part and a second part laterally adjacent to the first part. The first filter member comprises pores having an average size. The pores are configured to filter the liquid passing from the first part to the second part. The first filter member further comprises an opening adjacent to a top of the first chamber for air to pass from the first part to the second part. The opening has a size at least 10 times larger than the average size of the pores. There is a first inlet in fluid communication with the first part and a first outlet in fluid communication with the second part.

22 Claims, 26 Drawing Sheets

(56) References Cited

U.S. PATENT DOCUMENTS

| | | | | |
|---|---|---|---|---|
| 2007/0206075 | A1* | 9/2007 | Bulman et al. | 347/86 |
| 2007/0229633 | A1* | 10/2007 | Wada | 347/93 |
| 2008/0273070 | A1 | 11/2008 | Mun et al. | |
| 2010/0097433 | A1* | 4/2010 | Mukai et al. | 347/93 |
| 2010/0201764 | A1* | 8/2010 | Koehler et al. | 347/88 |
| 2011/0012964 | A1* | 1/2011 | Coffey et al. | 347/85 |
| 2011/0261123 | A1* | 10/2011 | Mehta et al. | 347/93 |
| 2011/0279607 | A1* | 11/2011 | Yamamoto et al. | 347/93 |

* cited by examiner

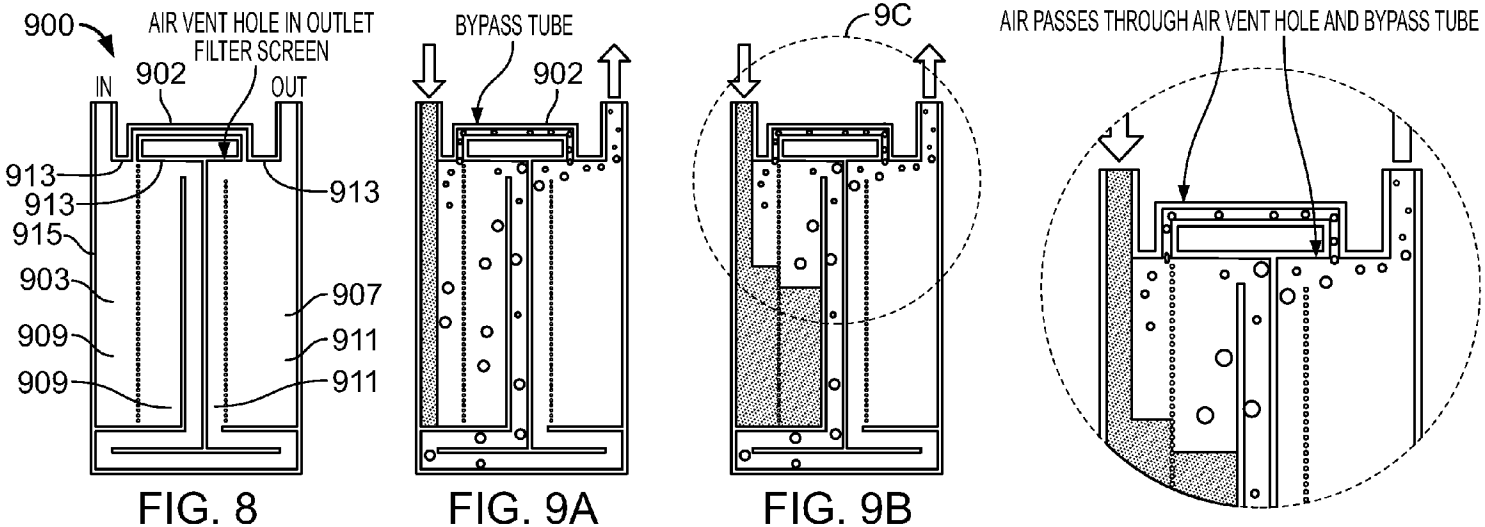
FIG. 8
FIG. 9A
FIG. 9B
FIG. 9C
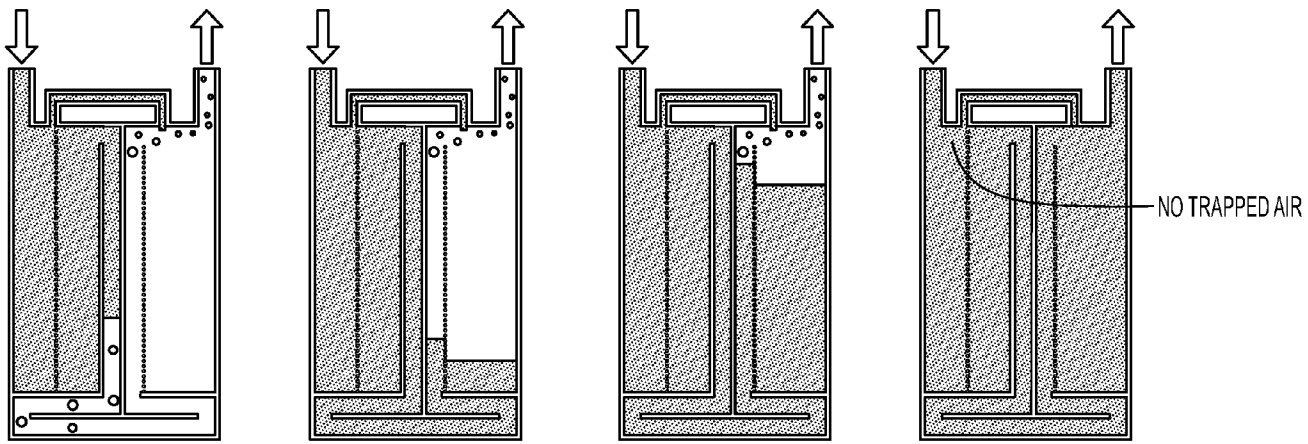
FIG. 9D
FIG. 9E
FIG. 9F
FIG. 9G FIG. 17B
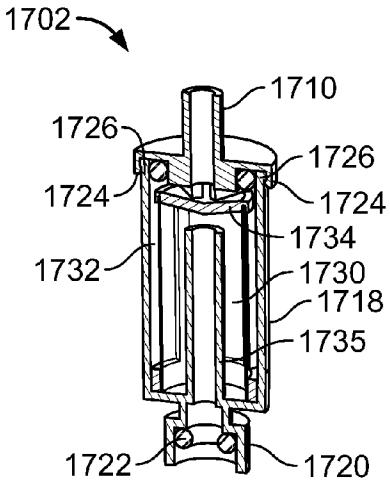
FIG. 17C
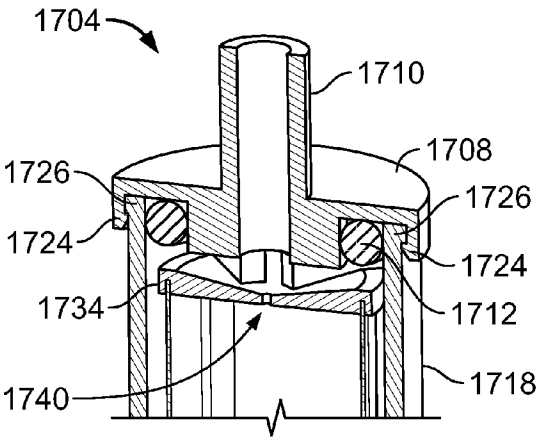
FIG. 17D
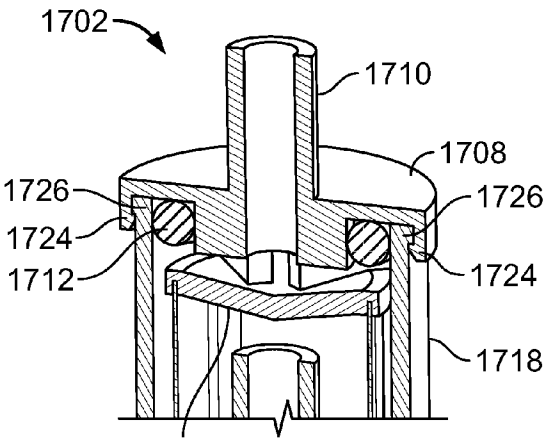
FIG. 17E

SYSTEMS AND METHODS FOR DELIVERING AND RECIRCULATING FLUIDS

TECHNICAL FIELD

This disclosure relates to systems and methods for delivering and recirculating fluids. The fluids delivered and recirculated are filtered for fluid ejection.

BACKGROUND

In ink jetting, a fluid to be jetted is filtered before being provided to a fluid ejection module for jetting, to remove particles and other debris that could possibly harm the fluid ejection module, e.g., by blocking normal jetting. In addition, before fluid jetting, air bubbles are removed from the fluid ejection module by fluid flushing or purging. In some implementations, in addition to be jetted, the fluid is also recirculated at a rate (e.g., mass/[cross-section*time]) higher than the rate at which the fluid is jetted. The recirculation can keep the fluid at a desired temperature and in a desired uniformity. Furthermore, the recirculation can also be used to remove air bubbles trapped in the fluid or along the fluid path.

As an example, referring to FIG. 1, in a fluid ejection assembly 100, a fluid is delivered from an inlet 162 through a housing 107 to a fluid ejection module 103 mounted to the housing 107 for ejection. In addition, the fluid is also recirculated between the inlet 162 and an outlet 166. The housing 107 includes an inner housing 130 and an outer housing 142. The inner housing 130 defines two chambers, an inlet chamber 132 and an outlet chamber 136 in communication with the inlet 162 and the outlet 166, respectively, through apertures 152, 156 in the inner housing 110. The chambers 132, 136 can be formed by a dividing wall 130 within the inner housing 110 or can be formed in two sub-housings that each defines a chamber. The wall 130 or the sub-housings can be held by a support 140 that sits on an interposer assembly 146 above the ejection module 103. The support 140 can also be configured to seal a cavity in the fluid ejection assembly 100 and to provide a bonding area for components of the assembly that are used in conjunction with the ejection module 103. In the assembly 100, a fluid to be ejected by the fluid ejection module 103 flows from the chamber 132 through fluid inlets 101 to the fluid ejection module 103. The fluid in the assembly 100 is also recirculated from the fluid ejection module 103 through fluid outlets 102 to the chamber 136 and/or directly between the chambers 132, 136.

The inlet chamber 132 contains a filter 133 diagonally positioned within the chamber. The fluid delivered from the inlet 162 has to pass the filter 133 before reaching the fluid ejection module 103. Optionally, the outlet chamber 136 also includes a filter 137. When the fluid is delivered or recirculated from the outlet 166 to the inlet 162, the filter 137 filters the fluid before the fluid reaches the fluid ejection module 103.

The outer housing 142 is connected to the inner housing 110 through a mounting frame 199. The outer housing 142 and the mounting frame 199 can be formed of two L-shaped parts, which allow the fluid ejection assembly 100 to be mounted on print bars with other assemblies that are the same or similar to the assembly 100. Such an arrangement can, for example, expand the print swath of the assembly 100 to a desired width. Other arrangements or designs can also be used. Fluid ejectors are also described in U.S. Patent Application Publication No. 2011/0080449, the entire content of which is incorporated herein by reference.

SUMMARY

In one aspect, the disclosure features a device for use in printing. The device comprises a first chamber for receiving a liquid and a first filter member in the first chamber. The first filter member separates the first chamber into a first part and a second part laterally adjacent to the first part. The first filter member comprises pores having an average size. The pores are configured to filter the liquid passing from the first part to the second part. The first filter member further comprises an opening adjacent to a top of the first chamber for air to pass from the first part to the second part. The opening has a size at least 10 times larger than the average size of the pores. There is a first inlet in fluid communication with the first part and a first outlet in fluid communication with the second part.

In another aspect, the disclosure features a method of making the device described above. In particular, implementations of the method include the one or more of the following features. The first filter is secured between a front cover and a back cover. The front cover and the back cover are sealed to each other to form the first chamber. The first filter is secured by bonding the first filter between the front and back covers or by ultra-sonically welding the first filter, the front cover, and the back cover.

In another aspect, the disclosure features a device for use in printing. The device comprises a first chamber for receiving a fluid and a first filter member in the first chamber. The first filter member separates the first chamber into a first part and a second part laterally adjacent to the first part. The first filter member is configured such that all fluid that enters the second part from the first part passes the first filter. There is a first inlet in fluid communication with the first part, a first outlet in fluid communication with the second part, a second chamber for receiving the fluid, and a second filter member in the second chamber. The second filter member separates the second chamber into a first part and a second part laterally adjacent to the first part. The second filter member is configured such that all fluid that enters the second part of the second chamber from the first part of the second chamber passes the second filter. There is a second inlet in fluid communication with the first part of the second chamber, a second outlet in fluid communication with the second part of the second chamber, a path between the first part of the second chamber and the second part of the first chamber. The path is configured to release air from the first part of the second chamber to the first outlet.

In another aspect, the disclosure features a method comprising receiving a fluid from an inlet of a second chamber delivered along a flow direction and filtering the received fluid through a second filter member in the second chamber. The second filter member separates the second chamber into a filtered part and an unfiltered part. The filtered fluid is received in the filtered part, and the unfiltered part of the second chamber contains air. After the filtered fluid fills the filtered part of the second chamber. The filtered fluid is delivered to a first chamber. The filtered part of the second chamber is free of air. The first filter member separates the first chamber into a filtered part and an unfiltered part. The first filter member is configured such that air in both the filtered part and the unfiltered part of the first chamber is evacuated through an outlet of the first chamber without trapping air in either of the filtered and unfiltered parts of the first chamber. The method further comprises reversing the flow direction by receiving the fluid from the outlet of the first chamber and delivering the fluid to the second chamber. Air contained in the unfiltered part of the second chamber is evacuated from the inlet along the reversed flow direction.

In another aspect, the disclosure features a method comprising receiving a fluid from an inlet of a second chamber and filtering the received fluid through a second filter member in the second chamber. The second filter member separates the second chamber into a filtered part and an unfiltered part, the filtered fluid being received in the filtered part. After the filtered fluid fills the filtered part of the second chamber, the fluid is delivered to a first chamber. The filtered part of the second chamber is free of air. The first chamber contains a first filter member. The first filter member separates the first chamber into a filtered part and an unfiltered part. The method further comprises removing air in the unfiltered part of the second chamber through a passage connecting the unfiltered part of the second chamber and the filtered part of the first chamber. The air is further removed through an outlet connected to the first chamber.

Implementations of the devices and methods may include one or more of the following features.

The average size of the pores is about 2 microns to about 10 microns and the opening has a size larger than 10 microns. The opening has a size of about 500 microns to about 1000 microns. The first filter member is arranged vertically within the first chamber. The opening is covered by a hydrophobic patch that is permeable to air and impermeable to the fluid. There is a second chamber for receiving the fluid and a second filter member in the second chamber. The second filter member separates the second chamber into a first part and a second part laterally adjacent to the first part. The second filter member is configured such that substantially all fluid that enters the second part from the first passes the second filter. There is a second inlet in fluid communication with the first part of the second chamber and a second outlet in fluid communication with the second part of the second chamber. The second filter member is arranged vertically in the second chamber. The second part of the second chamber and the second outlet are configured such that the second part of the second chamber is filled with the fluid before the fluid exits the second chamber from the second outlet. The second part of the second chamber contains a wall extending towards a top of the second chamber with a gap between the top of the second chamber and a top of the wall. The wall defines a fluid channel in communication with the second outlet. The second filter member comprises pores having an average size of about 2 microns to about 10 microns. A surface of the first filter member facing the first part of the first chamber is hydrophobic. A surface of the second filter member facing the first part of the second chamber is hydrophobic. The second filter member comprises an opening adjacent to a top of the second chamber. The opening having a size larger than 10 microns and is covered by a hydrophobic patch. The hydrophobic patch is permeable to air and impermeable to the fluid. There is a fluid pathway between the second part of the first chamber and the first part of the second chamber. The fluid pathway comprises a bypass tube. There is a hydrophobic patch covering the opening in the first filter. There is a hydrophobic patch covering a connection between the first part of the second chamber and the fluid pathway. The hydrophobic patch is permeable to air and impermeable to the fluid. There is a hydrophobic patch covering a connection between the first part of the second chamber and the fluid pathway. The hydrophobic patch is permeable to air and impermeable to the fluid. There is a printhead in communication with the first and second chambers. The first and second chambers are in indirect fluid communication through the printhead. The path has a cross-sectional diameter of about 800 microns to about 1 mm.

Implementations may provide one or more of the following advantages. An inlet filter is vertically arranged in an inlet chamber that delivers a fluid received from a fluid inlet to a fluid ejection module. The inlet filter separates the inlet chamber into an unfiltered compartment to receive an unfiltered fluid and a filtered compartment to receive a filtered fluid. The unfiltered compartment is in fluid communication with the fluid inlet. The fluid is filtered and is delivered to the fluid ejection module only from the filtered compartment. The filtered compartment is substantially fully filled before the fluid is delivered to the fluid ejection module and substantially no air is trapped in the filtered compartment.

In addition, an outlet filter can be vertically arranged in an outlet chamber. The outlet filter separates the outlet chamber into an unfiltered side and a filtered side. The filtered side is in fluid communication with the fluid ejection module and the unfiltered side is fluid communication with a fluid outlet. The outlet filter includes a hole at the top so that air trapped in the filtered side of the outlet chamber can pass the hole in the outlet filter and exit the outlet chamber through the fluid outlet. Both the filtered side and the unfiltered side can be substantially air free.

When the fluid ejection module is newly mounted onto the fluid ejector and before fluid jetting, fluid purging can be performed to remove air along all fluid paths in the fluid ejector. When the fluid is flushed along the direction from the fluid inlet, through the inlet chamber, the fluid ejection module, and the outlet chamber, to the fluid outlet, substantially all pathways downstream of the unfiltered compartment of the inlet chamber are free of air. The fluid is then purged or circulated along the reverse direction from the fluid outlet to the fluid inlet and possible air trapped in the unfiltered compartment of the inlet chamber is removed.

Alternatively, the fluid filter in the outlet chamber can be free of holes. Instead, a bypass passage, e.g., in the form of a tube, can be used to fluidically connect the unfiltered compartment of the inlet chamber and the unfiltered side of the outlet chamber. Air can be removed from the pathways of the fluid ejector using one fluid flush from the inlet to the outlet. The air otherwise could have been trapped in the unfiltered compartment of the inlet chamber is removed from the fluid outlet through the bypass passage.

Other features, objects, and advantages of the invention will be apparent from the description and drawings, and from the claims.

DESCRIPTION OF DRAWINGS

FIG. 8 is a schematic cross-sectional view of another fluid ejection assembly.

FIGS. 9A-9G are schematic cross-sectional views of the fluid ejection assembly of FIG. 8 in use.

FIG. 17E is a cross-sectional view of the sub-housings of the fluid ejection assembly of FIG. 17 in use.

DETAILED DESCRIPTION

Figure 1:
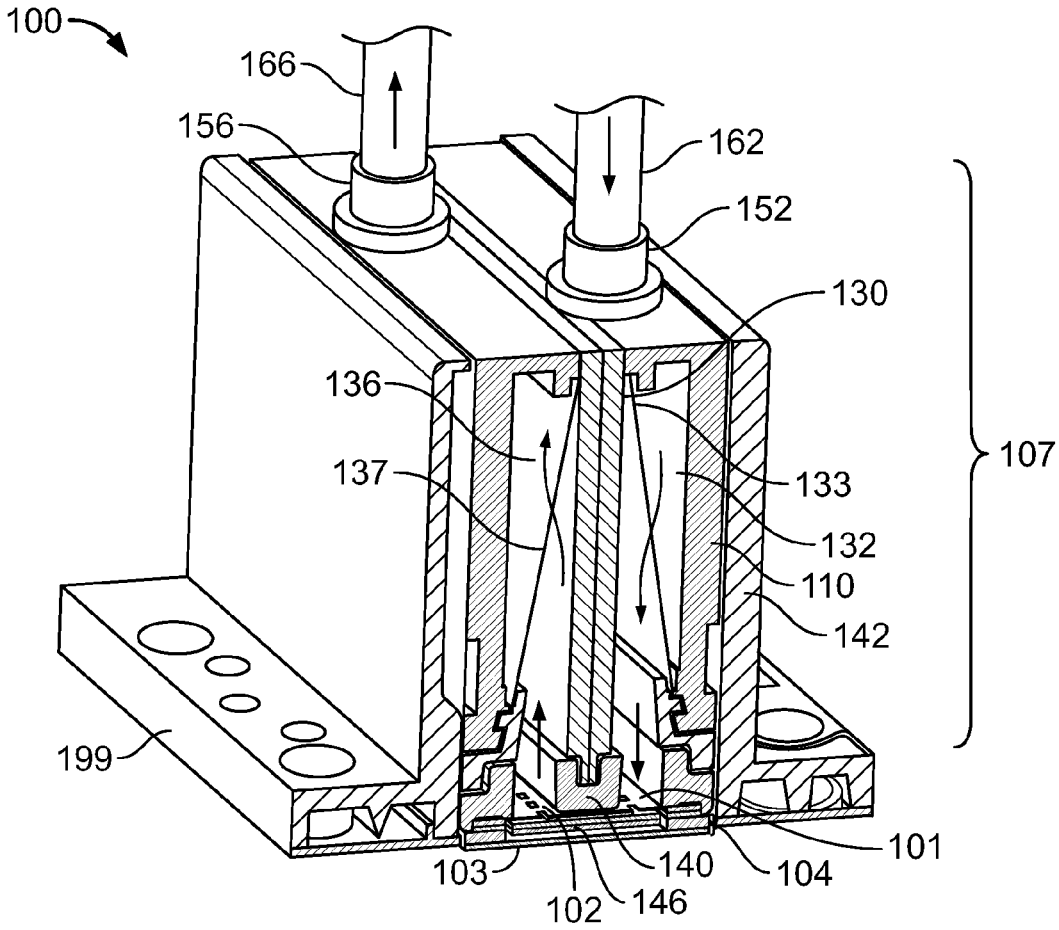
FIG. 1 is a perspective cross-sectional view of a fluid ejection assembly.
Figures 2, 3A, 3B, 3C, 3D, 3E, 3F, 3G:
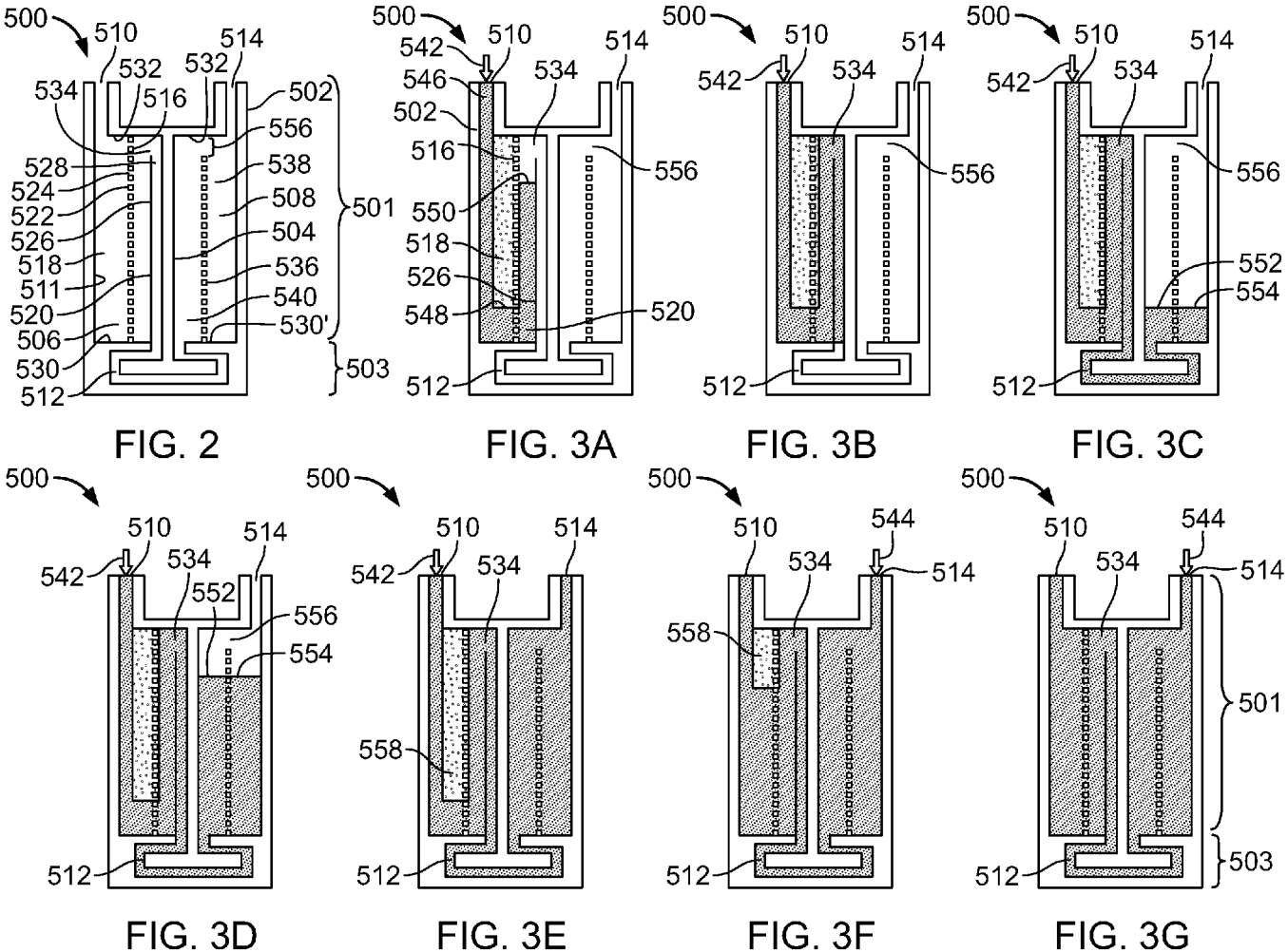
FIG. 2 is a schematic cross-sectional view of a fluid ejection assembly.
FIGS. 3A-3G are schematic cross-sectional views of the fluid ejection assembly of FIG. 2 in use.

Referring to FIG. 2, a fluid ejection assembly 500 includes a housing 501 connected to a die 503 in which one or more fluid ejection modules are formed. Although details are not shown in FIG. 2, each fluid ejection module can include a nozzle on the exposed face of the die, a pumping chamber fluidically connected to the nozzle, and an actuator (e.g., a piezoelectric or thermal actuator) to drive fluid from the pumping chamber toward and out of the nozzle.

Fluids to be jetted are delivered to the fluid ejection modules from the housing 501. In particular, the housing 501 includes an inlet 510 to receive a fluid from an external fluid supply (not shown) and an inlet chamber 506 that filters the received fluid. One or more fluid paths 512 (not all shown) in the die 503 (or partially formed between the housing 501 and the die 503) deliver the filtered fluid to the one or more fluid ejection modules for jetting. A portion of the filtered fluid is jetted through the nozzles, and another portion of the filtered fluid delivered to the fluid ejection modules is recirculated along the fluid path 512 to an outlet chamber 508 of the housing 501. The recirculated fluid exits the assembly 500 through a fluid outlet 514 of the housing 501 to the external fluid supply (or a different external fluid supply). The inlet and outlet chambers 506, 508 are housed in a housing wall 502 and are separated by a separation wall 504. In some implementations, the inlet and outlet chambers 506, 508 are formed in independent sub-housings (details discussed further below). The fluid in the two chambers 506, 508 communicates indirectly through the fluid path(s) 512.

The inlet chamber 506 contains an inlet filter 516 vertically arranged to separate the chamber 506 into an unfiltered compartment 518 and a filtered compartment 520 that are laterally adjacent to each other. The unfiltered compartment 518 is in fluid communication with the fluid inlet 510 and the filtered compartment 520 is in fluid communication with the fluid path 512. The filter 516 is in the form of a mesh or screen permeable to the fluid. In the figure, the filter 516 is illustrated by dots 522 and pores 524. However, the shown sizes of the dots and the pores are not to scale and are for illustration purposes only. The filter 516 is in contact with, e.g., attached to, the floor 530 and the ceiling 532 of the chamber 506 so that any fluid in the unfiltered compartment 518 has to pass the filter 516 before reaching the filtered compartment 520. There are no bypass routes between the unfiltered compartment 518 and the filtered compartment 520 such that the unfiltered fluid in the unfiltered compartment 518 (or from the fluid inlet 510) can enter the filtered compartment 520 without being filtered by the filter 516.

The inlet 510 is connected to the unfiltered compartment 518 near the top of the inlet chamber 506, e.g., by an opening in or adjacent the ceiling 532. The opening to the inlet 510 can be adjacent an interior wall 511 of the chamber 506 so that fluid entering flows down the interior wall 511 rather than on the filter 516.

Similarly, the fluid path 512 is connected to the filtered compartment 520 near the top of the inlet chamber 506, e.g., by an opening 534 or adjacent the ceiling 532. For example, the filtered compartment 520 can contains a wall 526 extending from the floor 530 and towards the ceiling 532 of the filtered compartment 520 without contacting the ceiling 532, leaving the opening 534 between the ceiling 532 and the wall 526. The wall 526 can be integrally formed with or can be attached to the housing wall 502. The wall 524 and the separation wall 504 form a fluid path 528 in the filtered compartment 520 that is fluidically connected with the fluid path 512. The filtered fluid in the filtered compartment 520 is delivered to the fluid path 512 through the opening 534 at the top of the filtered compartment 520 and the fluid path 528, and the fluid substantially fills, e.g., fully fills, the filtered compartment 520 before reaching the fluid path 512. During the process of filling the filtered compartment 520 and delivering the fluid to the fluid path 512, air trapped in the filtered compartment 520 can be substantially all, e.g., fully, removed from the filtered compartment towards the fluid path 512. The upward flow of the filtered fluid in the compartment 520 pushes the air into the fluid path 512 and the air exits the assembly 500 through nozzles of the fluid ejection modules and the outlet 514 (discussed in more detail below).

Optionally, the outlet chamber 508 also contains an outlet filter 536 vertically arranged to separate the chamber 508 into an unfiltered side 538 and a filtered side 540 that are laterally adjacent to each other. The outlet filter 536 is particularly useful when the fluid is supplied to the fluid ejection modules reversely from the outlet 514 towards the inlet 510. In such situations, the outlet filter 536 filters the fluid from the unfiltered side 538 and the filtered fluid is delivered from the filtered side 540 to the fluid ejection modules.

The fluid path 512 is connected to the filtered side 540 of the outlet chamber 508 near the bottom of the outlet chamber 508, e.g., by an opening in or adjacent the floor 530'. The outlet 514 is connected to the unfiltered side 538 of the outlet chamber 508 near the top of the outlet chamber 508, e.g., by an opening in or adjacent the ceiling 532.

The filter 536 extends from, e.g., is connected to the floor 530' of the chamber 508 towards the ceiling 532' without contacting the ceiling 532', leaving an opening 556 between the ceiling 532' and the filter 536. In some implementation, the filter 536 contains the opening 556 and is connected to the floor 530' and the ceiling 532' of the chamber 508, e.g., similar to the arrangement of the filter 516 in the chamber 506. The opening 556 has a width of about 500 microns to about 1000 microns, e.g., 800 microns and allows air to travel between the two sides 538, 540 freely without substantial impedance. Generally, the filter 536 has a surface area of about 700 $mm^2$ or larger and provides a much larger flow area than the opening 556. In some implementations, the surface area of the opening 556 is about 0.012% to about 0.200%, e.g., 0.077% of the surface area of the filter 536. Substantially all fluid in the filtered side 540 passes the filter 536 to the unfiltered side 538. In some implementations, a small amount of the fluid passes the opening 556 from the filtered side 540 to the unfiltered side 538.

In some implementations, in use, the opening 556 is wet with the fluid in the assembly 500. The size of the opening 556 is selected based on bubble pressure $P_b$ of the opening, which represents a pressure needed to push air through a wet opening and produce a bubble. The bubble pressure $P_b$ can be calculated as:

$$P_b = 2*\text{sigma}/R,$$

where sigma is the surface tension of the fluid and R is the radius of the opening. For example, with a radius of 0.5 mm and a surface tension of 0.03 N/m, the bubble pressure would be 120 Pa.

As an example, the total pressure drop across the fluid ejection assembly 500 is about 2000 Pa, and assuming that the filters 516, 536 each have about 10% of the total resistance, the pressure drop across each filter is about 200 Pa. This pressure difference across the filter is greater than the above calculated 120 Pa, and allows the air to pass the opening 556 having a radius of 0.5 mm even when the opening 556 is wet.

The opening sizes can adjusted based on the calculation and implementation to provide desired uses. In some implementations, the size of the opening 556 is at least 10 times larger than the average size of the pores in the filter 536 for filtering the fluid. For example, the opening 556 can have a surface area that is about 50 to 1000, e.g., 200, 400, 500, or 600 times the average surface area of the filter pores.

Figure 2A:
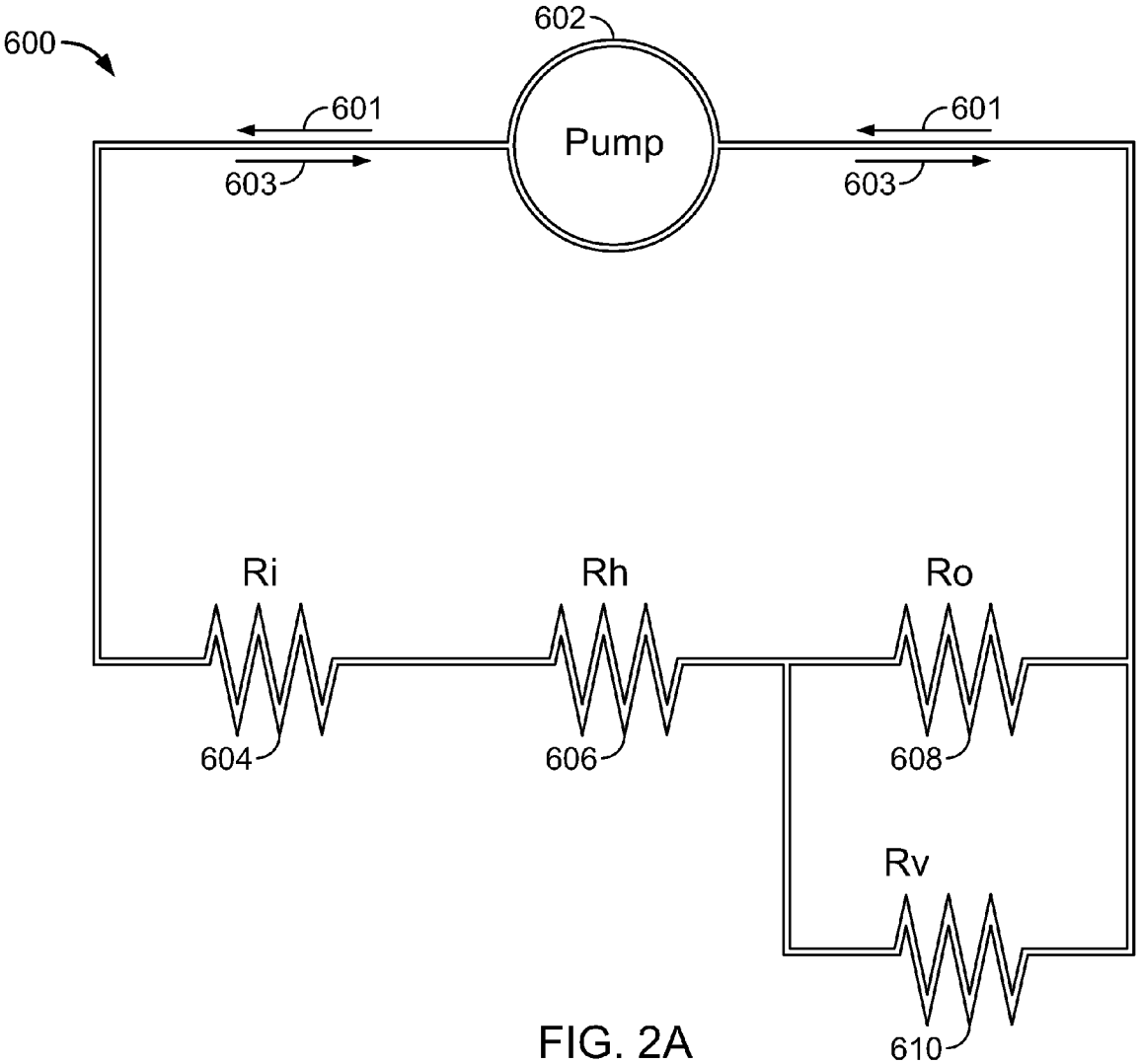
FIG. 2A is a schematic diagram of flow resistance distribution within the fluid ejection assembly of FIG. 2.

Referring to FIG. 2A, the fluid flowing in the assembly 500 encounters flow resistances, a distribution 600 of which is schematically shown. In particular, when a fluid pump 602 pumps the fluid towards the inlet 510 (FIG. 2) along a direction 601 or reversely towards the outlet 514 along a reverse direction 603, the major fluid resistances encountered by the fluid along the pathway between the inlet 510 and the outlet 514 include serially connected resistance Ri from the inlet filter 516, resistance Rh from the die 503, and effective resistance of parallel connected resistances Ro from the outlet filter 536 and Rv from the opening 556.

The filters 516, 536 can be formed as an integral part of the housing 500 or can be pre-formed and installed into the housing 500 (examples of implementations discussed further below). The filters can be made from plastic (e.g., liquid crystal polymer (LCP), polyethylene, or polypropylene), metal (e.g., stainless steel), metal alloy (e.g. zinc, magnesium, or steel alloy) with a corrosion resistant coating (e.g., parylene, atomic level deposition (ALD) coating like silicon oxide, inert metal like gold or iridium), a ceramic (e.g. silicon dioxide or aluminum oxide), or other suitable materials. In some implementations, the filters have a hydrophilic surface with a good wettability to the fluid. For example, the filters can be coated with silicon dioxide to improve their wettability, which in turn facilitates the fluid filling process across the filters.

The surface area, porosity, and pore sizes of the filters are chosen so that a fluid can pass the filters when the pressure difference across the filters is within a predetermined range, e.g., a desired pressure drop across the print modules. Features of the filters are also chosen so that particles larger than a predetermined particle filtration size are blocked from passing the filters. Without wishing to be bound by theory, it is believed that the pressure drop across the print head and the filters is based on the system's flow resistance times the maximum flow rate within the system. It is further believed that the maximum flow rate is the flow rate when all the nozzles are printing (with the largest drop size) plus the recirculation flow rate.

In some implementations, the fluid recirculation rate is about $1.0\times10^{-4}$ liter/second to about $5.0\times10^{-4}$ liter/second, e.g., $2.83\times10^{-4}$ liter/second, and the maximum flow rate within the system of about $2.0\times10^{-4}$ liter/second to about $15.0\times10^{-4}$ liter/second, e.g., $7.7\times10^{-4}$ liter/second. In some implementations, the pressure drop across the print modules and the filters is 0.2 psi to about 1 psi, e.g., 0.5 psi or 0.56 psi. The particle filtration size can be about 8-9 microns absolute and about 2 microns nominal.

In some implementations, the filters are in the form of wires woven about stainless steel supports, e.g., warp woven or weft woven wires available by Sefar, Inc. (Depew, N.Y.). For example, the filter can have 325×2300 mesh count per square inch; the wire diameter can be 0.015×0.010 inches; the absolute filter rating (e.g., absolute particle size) can be 8-9 microns; the nominal filter rating (e.g., nominal particle size) can be about 2 microns; and the weight of stainless steel is about 9.27 lb/100 square feet.

In use, prior to fluid jetting, air can be removed from the assembly 500 using two fluid flushes along two opposite directions. Furthermore, during the fluid jetting, filtered fluids can be continuously supplied to the fluid ejection modules and be recirculated without trapping a substantial amount of air in the assembly (examples of fluid recirculation is discussed further below). Referring to FIG. 3A-3G, processes of air removal using the two fluid flushes are shown. The assemblies shown in FIG. 3A-3G are the same assembly and each is the same as the assembly 500 of FIG. 2. For simplicity, not all parts of the assembly are labeled in each of FIGS. 3A-3G, the same terms are used for the same parts shown in FIGS. 2 and 3A-3G, and the same parts have the same features in these figures. In particular, FIGS. 3A-3E show one of the two fluid flushes along the fluid supply direction (indicated by an arrow 542) from the inlet 510 towards the fluid path 512 and the fluid outlet 514. FIGS. 3F-3G show the other fluid flush along the reverse fluid supply direction (indicated by an arrow 544) from the outlet 514 towards the fluid path 512 and the fluid inlet 510.

Referring particularly to FIG. 3A, a fluid 546 is filled into the empty assembly 500 from the inlet 510, e.g., by pumping the fluid along the direction 601 of FIG. 2A. The fluid 546 gradually accumulates in the unfiltered compartment 518 from the floor 530, while some of the fluid 546 permeates the filter 516 into the filtered compartment 520. As the fluid 546 is continuously filled into the assembly 500, a free surface 548 of the unfiltered fluid in the unfiltered compartment 518 and a free surface 550 of the filtered fluid in the filtered compartment 520 both rise. In some implementations, the physical features of the assembly 500 and the fluid 546, e.g., the surface wettability and permeability of the inlet filter 516, the surface tension and viscosity of the fluid 546, and others, may cause the free surfaces 548, 550 to rise at different speeds. In the example shown in FIG. 3A, the free surface 550 rises faster than the free surface 548. In some situations, although the fluid keeps entering the filtered compartment 520 through the filter, the free surface 548 stops rising after a certain amount of time, leaving air in the unfiltered compartment 518. Referring to FIG. 3B, as the fluid filling shown in FIG. 3A continues, the free surface 550 rises to the top of the filtered compartment 520 and the fluid starts to fill the fluid path 528. Before reaching the fluid path 512, substantially all air in the filtered compartment 520 is forced out by the fluid filling process. Referring to FIG. 3C, the fluid continues to fill the fluid path 512 and enters the die 503, while removing substantially all air in the fluid path 512. In some implementations, the fluid is purged from nozzles of the fluid ejection module(s) in the die 503 so that substantially all air within the fluid ejection module(s) is removed.

As the fluid reaches the filtered side 540 of the outlet chamber 508, it accumulates from the floor 530 and permeates to the unfiltered side 538 through the filter 536. The fluid in the filtered side 540 has a free surface 552 and the fluid in the unfiltered side 538 has a free surface 554. The air in the unfiltered side 538 communicates with the air in the filtered side 540 though the opening 556, maintaining the same air pressure in both sides 538, 540. In some implementations, referring to FIG. 3D, the two free surfaces 552, 554 rise at substantially the same speed and push the air above the free surfaces 552, 554 to exit the outlet chamber 508 from the outlet 514. Referring to FIG. 3F, the entire outlet chamber 508 and the outlet 514 are filled with the fluid 546, and substantially all air in the chamber 508 are removed. The fluid flush in the fluid supply direction is completed, with substantially all air in all parts of the assembly 500 removed, except for possibly air 558 trapped in the unfiltered compartment 518 of the inlet chamber 506.

Next, the air 558 trapped in the unfiltered compartment 518 from the fluid flush of FIGS. 3A-3E is removed by implementing a fluid flush in the reverse fluid supply direction 544, as shown in FIGS. 3F-3G. For example, as described in FIG. 2A, the pump 602 can reversely pump the fluid along the direction 603 from the outlet 514 towards the inlet 510. The fluid flow forces the trapped air 558 out of the inlet 510 so that the assembly 500 and all pathways in the fluid ejection module(s) are substantially free of air and fluid ejection can be started.

Figures 4, 5A, 5B, 5C, 5D, 5E, 5F, 5G:
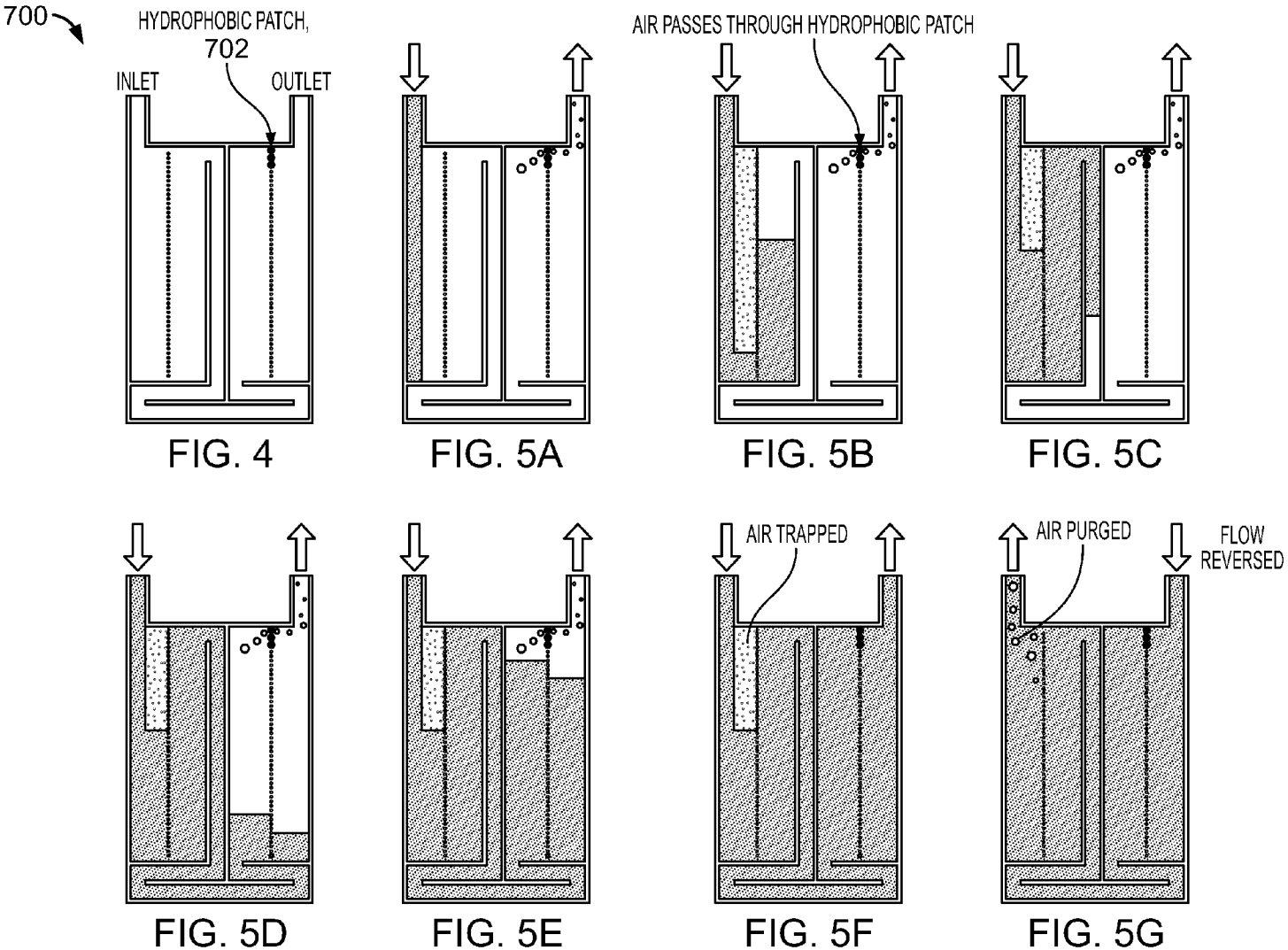
FIG. 4 is a schematic cross-sectional view of another fluid ejection assembly.
FIGS. 5A-5G are schematic cross-sectional views of the fluid ejection assembly of FIG. 4 in use.

Alternatively, referring to FIG. 4, an assembly 700 is identical to the assembly 500 of FIG. 2, except that the opening 556 in the outlet filter 536 is covered by a hydrophobic patch 702. For simplicity, the parts of the assembly 700 that are identical to those of the assembly 500 are not numbered and the same terms used for the assembly 500 are used for the assembly 700. The identical parts of the assemblies 700, 500 have similar or the same features. The hydrophobic patch 702 is permeable to air and impermeable to the fluid under the fluid pressure difference between the filtered and unfiltered sides of the outlet chamber. Suitable materials for the hydrophobic patch 702 include Teflon, a polyolefin material, or a fluorinated coating on a portion of the filter.

Figure 4A:
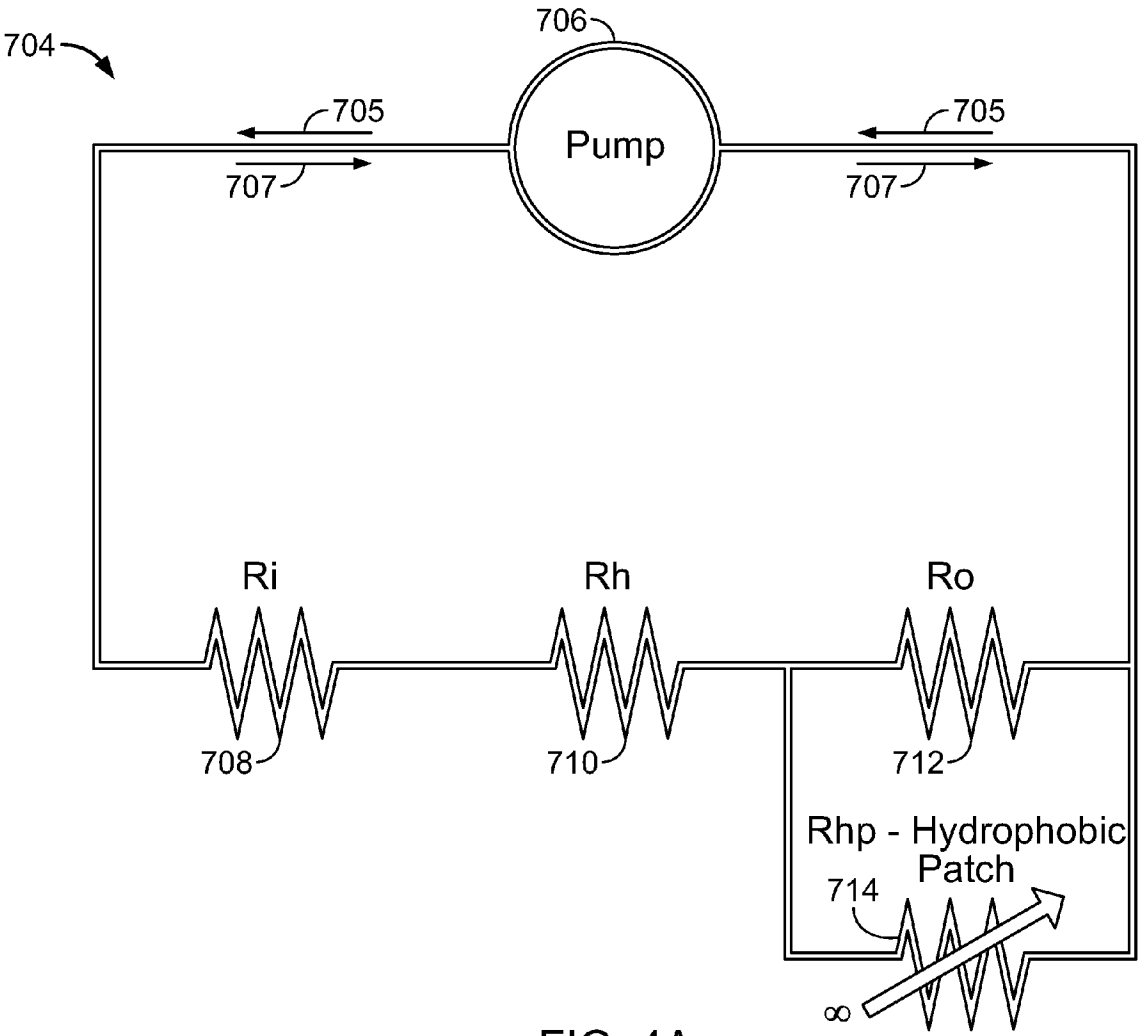
FIG. 4A is a schematic diagram of flow resistance distribution within the fluid ejection assembly of FIG. 4.

As a result, referring to FIG. 4A, the flow resistance distribution 704 for a fluid flowing in the assembly 700 is different from the flow resistance distribution 600 associated with the assembly 500. In particular, the fluid flow in the assembly 700, pumped by a pump 706 along a direction 705 or a reverse direction 706, encounters serially connected resistance Ri from the inlet filter, resistance Rh from the die, and resistances Ro from the outlet filter. The fluid resistance Rhp of the hydrophobic patch, although is connected to the resistance Ro in parallel, is effectively infinite, so that the hydrophobic patch 702 is effectively not part of the fluid flow paths in the assembly 700.

In use, when the fluid is flushed from the fluid inlet towards the fluid outlet, as shown in FIGS. 5A-5F and similar to FIGS. 3A-3E, all air in the outlet chamber is forced out from the outlet. However, all fluid from the filtered side of the outlet chamber passes the filter to reach the unfiltered side of the outlet chamber. Similar to FIGS. 3A-3E, when one fluid flush is completed, air may be trapped in the unfiltered compartment of the inlet chamber, as shown in FIG. 5F.

Similar to the removal of the air 558 in FIG. 3F, referring to FIG. 5G, a reverse fluid flush that flows the fluid reversely from the outlet towards the inlet purges the air trapped in the unfiltered compartment of the inlet chamber and the assembly 700 with all fluid paths in the fluid ejection module(s) are substantially air free. During the reverse fluid flush, the fluid-impermeable hydrophobic patch 702 forces all fluid to pass the outlet filter to reach the filtered side and the fluid ejection module(s) so that the fluid is substantially free of debris or particles that may damage the fluid ejection module(s) or adversely affect the normal fluid ejection.

Figures 6, 7A, 7B, 7C, 7D, 7E, 7F:
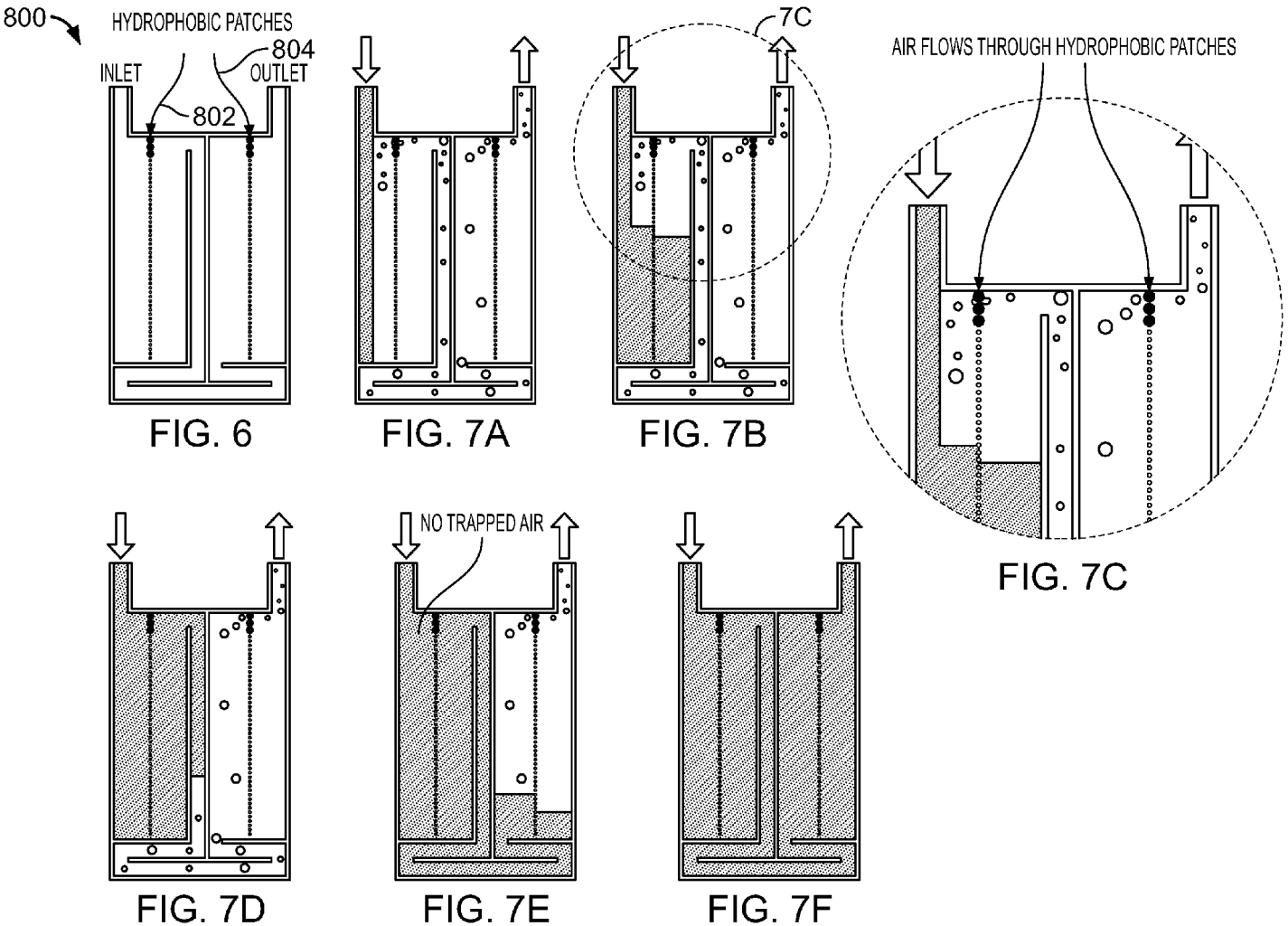
FIG. 6 is a schematic cross-sectional view of another fluid ejection assembly.
FIGS. 7A-7F are schematic cross-sectional views of the fluid ejection assembly of FIG. 6 in use.

Referring to FIG. 6, an assembly 800 is identical to the assembly 700 of FIG. 4, except that in addition to the hydrophobic patch 804 that has similar or the same features as the hydrophobic patch 702 on the outlet filter in FIG. 4, the inlet filter also includes a hydrophobic patch 802 that has features similar to or the same as the patch 804. In some implementations, the inlet filter is identical to the outlet filter. For simplicity, the parts of the housing 800 that are identical to those of the housings 500, 700 are generally not numbered and the same terms used for the housings 500, 700 are used for the housing 800. The identical parts of the assemblies 800, 700, 500 have similar or the same features. The hydrophobic patch 802 is located directly under or near the ceiling of the inlet chamber to cover an opening in the inlet filter. The hydrophobic patch 802 is permeable to air and impermeable to the fluid under the pressure difference between the filtered and unfiltered compartments of the inlet chamber.

Figure 6A:
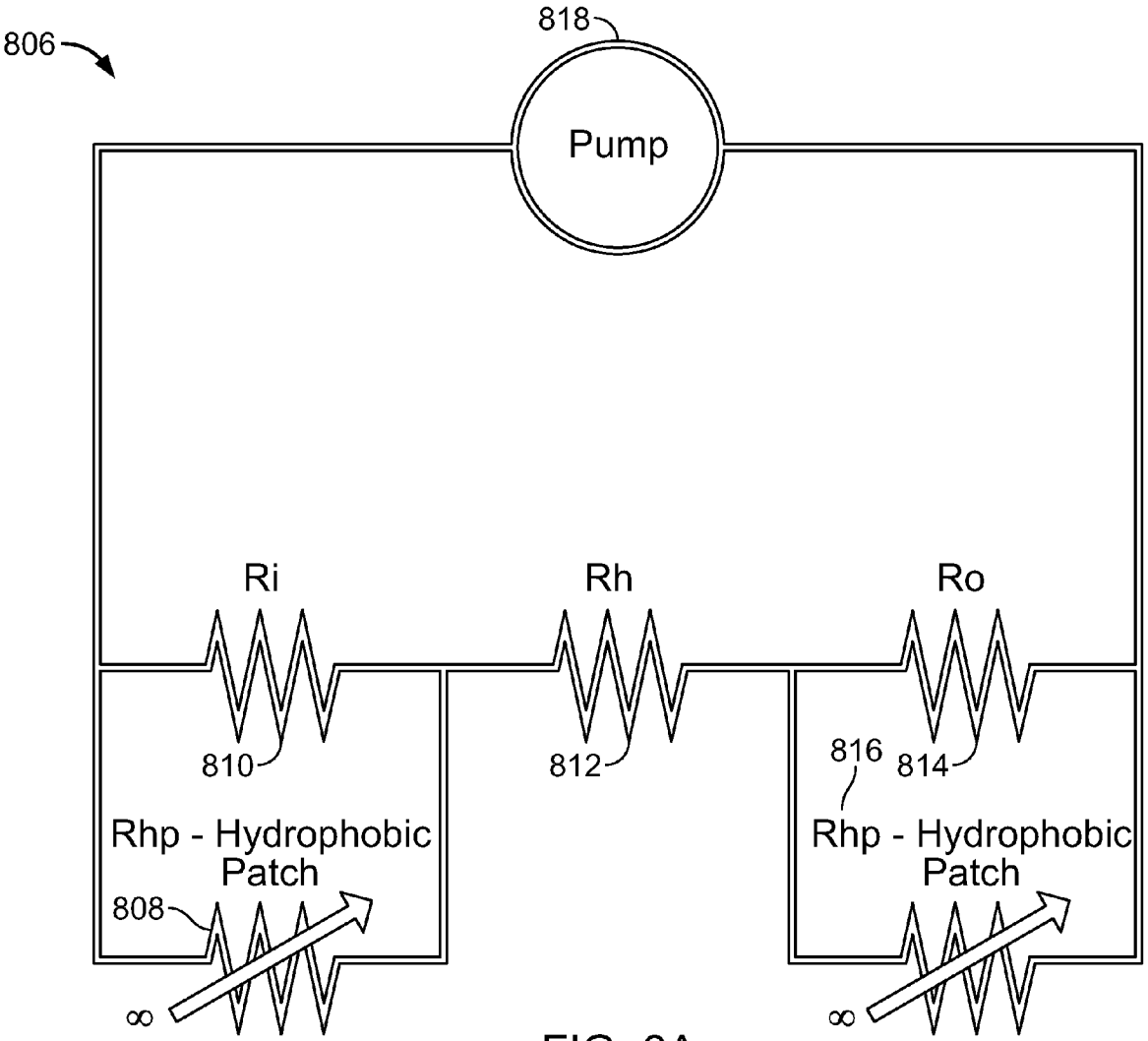
FIG. 6A is a schematic diagram of flow resistance distribution within the fluid ejection assembly of FIG. 6.

Referring to FIG. 6A, the flow resistance distribution 806 for a fluid flow within the assembly 800 is different from the flow resistance distribution 704 of FIG. 4A, in that there is a resistance Rhp 808 from the hydrophobic patch 802 (having an effective value of infinite) connected in parallel to the resistance Ri 810 from the inlet filter. Other resistances include Rh 812 from the die, Ro 814 from the outlet filter, and Rhp 816 (having an effective value of infinite) from the patch 804 and connected to Ro in parallel. Effectively, the fluid pumped by a pump 818 and flowing between the inlet and the outlet of the assembly 800 encounters serially connected resistances Ri, Ro, and Rh within the assembly 800.

In use, only one fluid flush along one fluid direction is needed to purge substantially all air from the assembly 800. In particular, referring to FIGS. 7A-7F, different from FIGS. 3A-3E and FIGS. 5A-5F, when the fluid is flushed from the inlet towards the outlet, air in the unfiltered compartment of the inlet chamber passes the hydrophobic patch 802 into the filtered compartment and substantially no air is trapped in the unfiltered compartment when the unfiltered chamber is filled with the fluid. The air in the filtered compartment continues to move towards the outlet chamber as the fluid fills up the filtered compartment. In the meantime, the air reaching the filtered side of the outlet chamber passes the hydrophobic patch 804 to exit the outlet. Eventually, when both the inlet and the outlet chambers are filled with the fluid, substantially no air is trapped in the assembly 800 and no additional fluid flushes, such as a reverse fluid flush, are needed. The operation of the assembly 800 is simplified.

Referring to FIG. 8, an assembly 900 is identical to the assembly 500 of FIG. 2, except that the assembly 900 additionally includes a bypass passage 902 connecting the unfiltered compartment 903 of the inlet chamber 909 and the unfiltered side 907 of the outlet chamber 911. In particular, the openings to the bypass passage 902 are located in or adjacent or the ceiling 913 on both the inlet chamber 909 and the outlet chamber 911. For simplicity, the parts of the assembly 900 that are identical to those of the assembly 500 are generally not numbered and the same terms used for the assembly 500 are used for the assembly 900. The identical parts of the assemblies 900, 500 have similar or the same features. The bypass passage 902 allows both the fluid and the air in the unfiltered compartment of the inlet chamber to reach the unfiltered side of the outlet chamber. Such bypassing fluid is unfiltered. However, the bypassing fluid does not pass the die or the fluid ejection module(s) in the die, and does not cause any adverse effects to the fluid jetting. The bypass passage 902 can be a stiff material made of the same material as the housing wall 914, e.g., a molded part of the housing 915, or the bypass passage could be a separate tube attached to the housing 915. In some implementations, a substantial part of the passage 902 is arranged in parallel to the ceiling 913 of the housing 915. Other materials and arrangements can also be used. In some implementations, the bypass passage 902 is a soft material, such as a plastic, polyurethane, polyolefin material, thermoplastic elastomer, or ethylene propylene diene monomer (EPDM) rubber. The passage 902 can have a suitable length to connect the unfiltered compartment and the unfiltered side. In some implementations, the bypass passage 902 has a cross-sectional width similar to the width of the opening 556 in the filter, such as about 330 microns to about 1300 microns. The flow rate of a fluid through the bypass tube 902 can be about the same as the flow rate through the bypass opening 556.

Figure 8A:
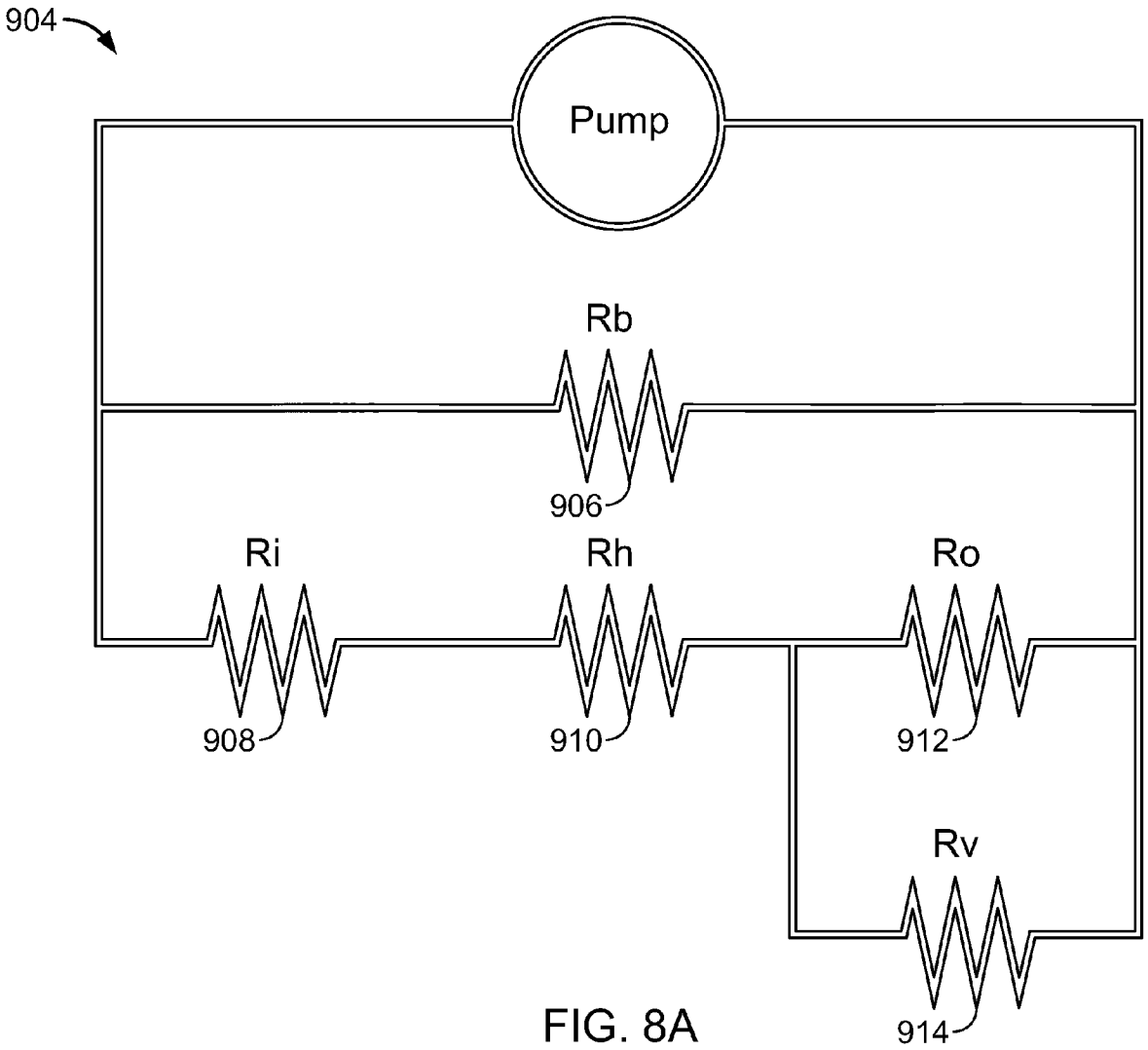
FIG. 8A is a schematic diagram of flow resistance distribution within the fluid ejection assembly of FIG. 8.

As a result, the fluid flow resistance 904 of FIG. 8A for the fluid flow in the assembly 900 of FIG. 8 is different from the fluid flow resistance 600 of FIG. 2A associated with the assembly 500 of FIG. 2. In particular, the fluid encounters a resistance Rb 906 from the bypass passage 902, which is effectively connected in parallel to serially connected resistances: a resistance Ri 908 from the inlet filter, a resistance 910 from the die, and an effective resistance from parallelly connected resistances Ro 912 from the outlet filter and Rv 914 from the opening in the outlet filter.

In use, only one fluid flush along one fluid direction is needed to purge substantially all air from the assembly 900. In particular, referring to FIGS. 9A-9G, different from FIGS. 3A-3E, when the fluid is flushed from the inlet towards the outlet, some air in the unfiltered compartment of the inlet chamber enters the unfiltered side of the outlet chamber through the bypass passage 902 and some air passes the filter to the filtered compartment of the inlet chamber. Substantially no air is trapped in the unfiltered compartment of the inlet chamber. The air in the filtered compartment continues to move towards the outlet chamber as the fluid fills up the filtered compartment and is removed from the assembly 900 through the outlet in a similar or the same way as described for FIGS. 3A-3E. In the meantime, the air in the filtered side of the outlet chamber passes the opening in outlet filter to the unfiltered side, from which the air is removed from the assembly through the outlet. Eventually, when both the inlet and the outlet chambers are filled with the fluid, substantially no air is trapped in the assembly 900 and no additional fluid flushes, such as a reverse fluid flush, are needed. The operation of the assembly 900 is simplified.

Figures 10, 11A, 11B, 11C, 11D, 11E, 11F, 11G:
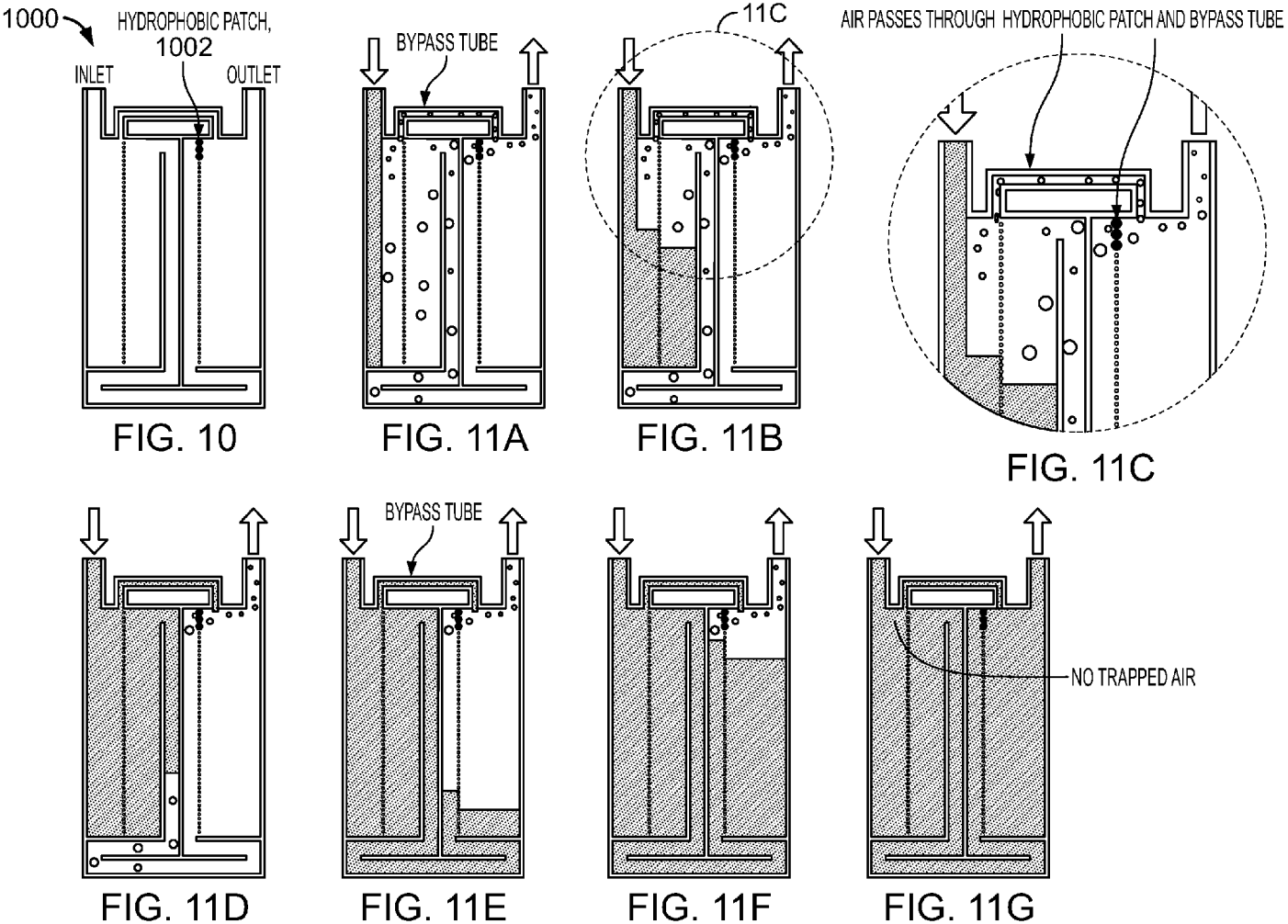
FIG. 10 is a schematic cross-sectional view of another fluid ejection assembly.
FIGS. 11A-11G are schematic cross-sectional views of the fluid ejection assembly of FIG. 10 in use.

Referring to FIG. 10, an assembly 1000 is identical to the assembly 900 of FIG. 8, except that instead of including an opening in the outlet filter, the assembly 1000 includes a hydrophobic patch 1002 covering the opening. For simplicity, the parts of the assembly 1000 that are identical to those of the assembly 900 are generally not numbered and the same terms used for the housing 900 are used for the assembly 1000. The identical parts of the assemblies 1000, 900 have similar or the same features. The hydrophobic patch 1002 has features similar to or the same as the hydrophobic patch 702 of FIG. 4. For example, the hydrophobic patch 1002 is permeable to air and is impermeable to the fluid under the pressure difference between the filtered and unfiltered sides of the outlet chamber.

Figure 10A:
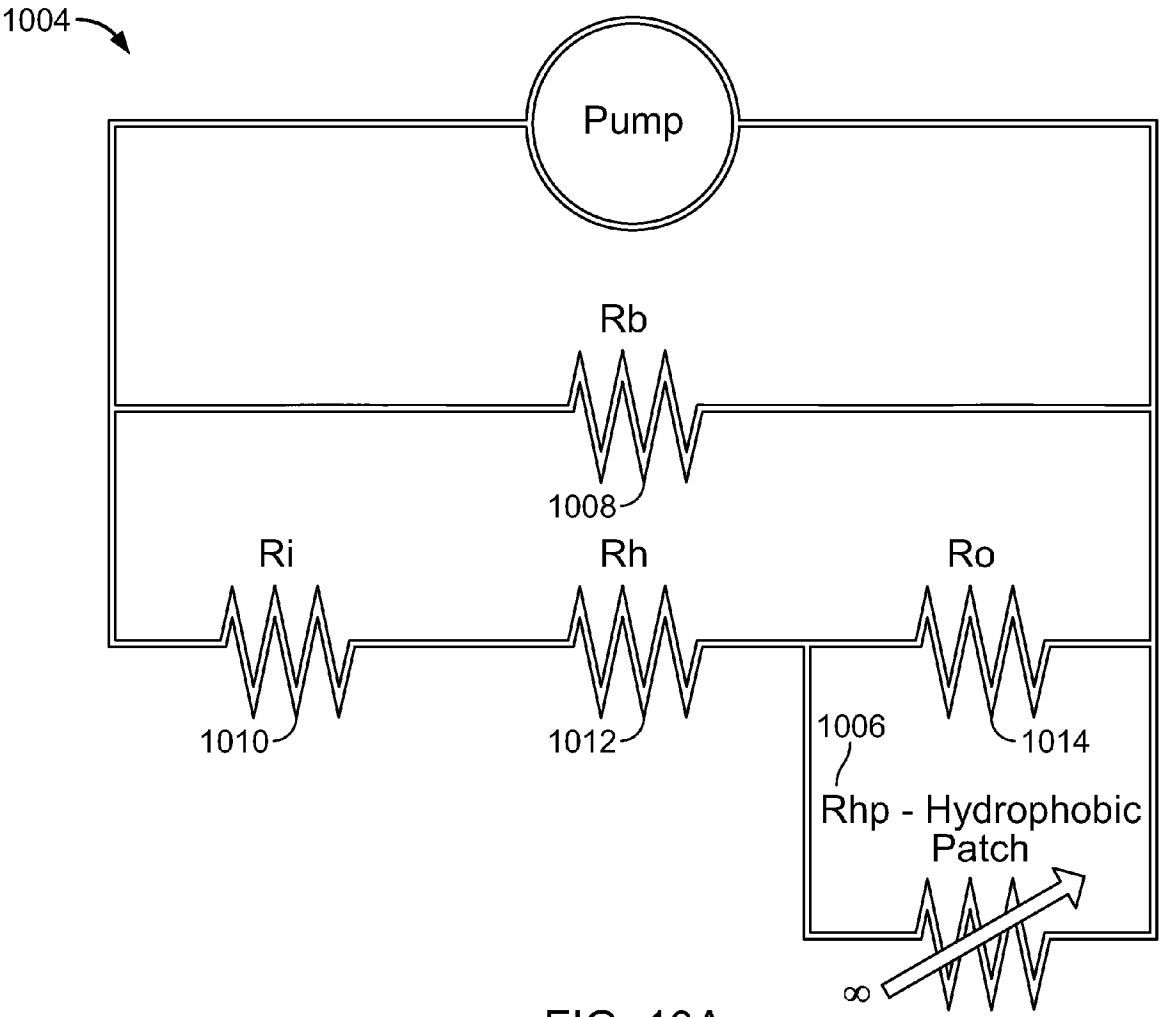
FIG. 10A is a schematic diagram of flow resistance distribution within the fluid ejection assembly of FIG. 10.

FIG. 10A shows the flow resistance distribution 1004 for the fluid flow in the assembly 1000 of FIG. 10, which is different from the flow resistance distribution 904 of FIG. 8A, in that, instead of Rv 914 from the opening in the outlet filter, Rph 1006 from the hydrophobic patch (having an effective value of infinite) is connected in parallel to the resistance Ro from the outlet filter. Effectively, the flow resistance in the assembly 1000 includes a flow resistance Rb 1008 from the bypass passage, which is connected in parallel to three serially connected resistances: a resistance Ri 1010 from the inlet filter, a resistance 1012 from the die, and a resistance Ro 1014 from the outlet filter.

In use, as shown in FIGS. 11A-11G, the assembly 1000 also needs only one fluid flush to remove substantially all air in the assembly. In particular, similar to FIGS. 9A-9C, air in the unfiltered compartment of the inlet chamber is substantially all removed, either to the unfiltered side of the outlet chamber through the bypass passage or to the filtered compartment of the inlet chamber through the inlet filter. Some of the fluid may also flow through the bypass passage from the unfiltered compartment to the unfiltered side. The air downstream of the unfiltered compartment is continuously moved towards the outlet chamber as more fluid flows in. In the meantime, the air in the filtered side of the outlet chamber passes through the hydrophobic patch 1002 to the unfiltered side and the air in the unfiltered side exits the outlet. Substantially no air is trapped in the assembly 1000 when both the inlet and the outlet chambers are filled with the fluid. In some implementations, the fluid may be delivered to the assembly 1000 through the outlet and the fluid-impermeable hydrophobic patch 1002 forces all unfiltered fluid to pass the outlet filter and prevents debris from entering the filtered side of the outlet chamber and further the fluid ejection module(s).

Figures 12, 13A, 13B, 13C, 13D, 13E, 13F, 13G:
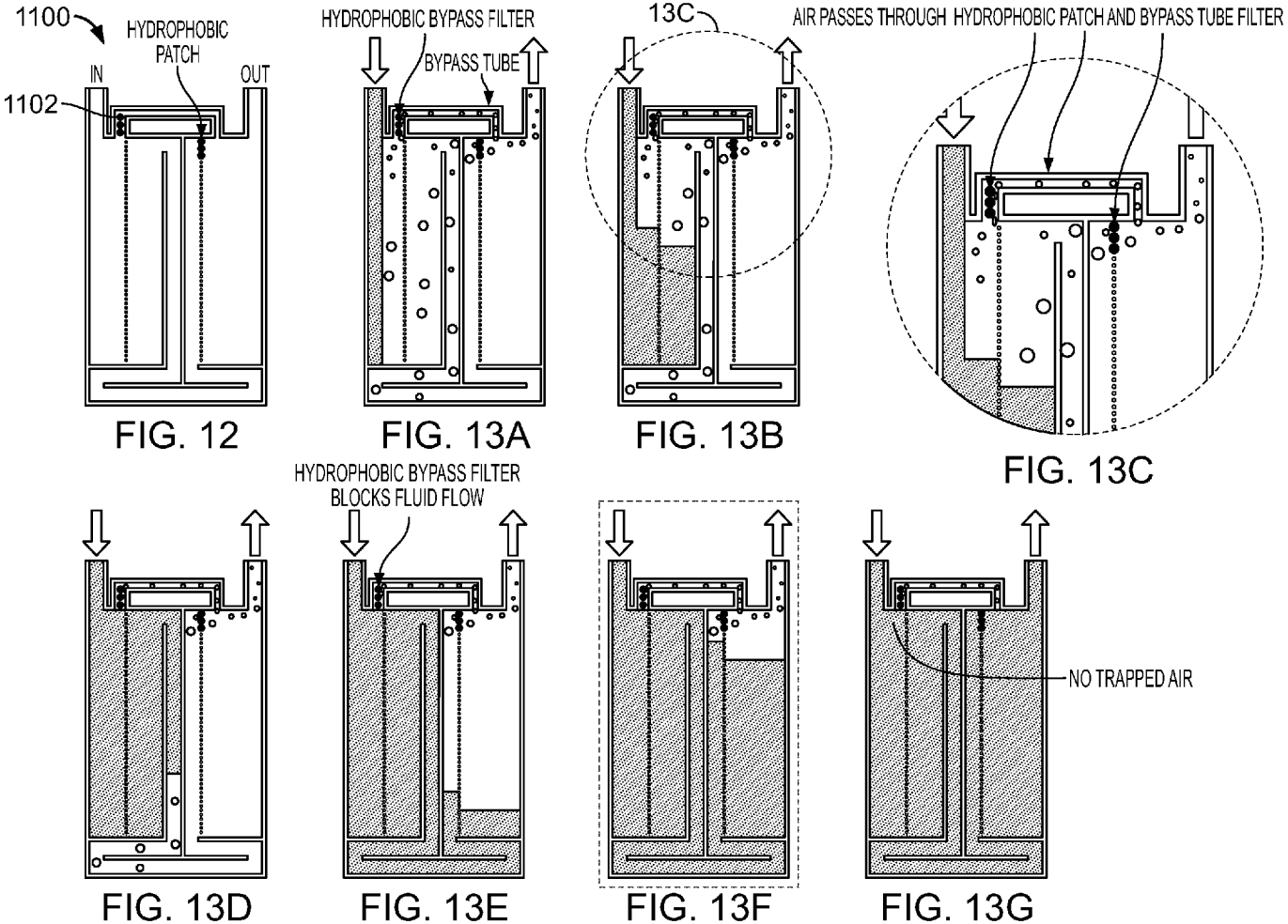
FIG. 12 is a schematic cross-sectional view of another fluid ejection assembly.
FIGS. 13A-13G are schematic cross-sectional views of the fluid ejection assembly of FIG. 12 in use.

Referring to FIG. 12, an assembly 1100 is identical to the assembly 1000 of FIG. 10, except that a hydrophobic bypass filter 1102 is placed at the opening of the bypass passage where the bypass passage is connected to the unfiltered compartment of the inlet chamber. For simplicity, the parts of the assembly 1100 that are identical to those of the assembly 1000 are generally not numbered and the same terms used for the housing 1000 are used for the assembly 1100. The identical parts of the assemblies 1000, 1100 have similar or the same features. The hydrophobic bypass filter 1102 can be made of materials similar to or the same as materials for the hydrophobic patch. The hydrophobic bypass filter 1102 is permeable to air and impermeable to the fluid under the pressure difference between the unfiltered compartment of the inlet chamber and the unfiltered side of the outlet chamber. The size of the hydrophobic bypass filter 1102 is selected such that when placed at the opening of the bypass passage, it fully blocks the cross-section of the bypass passage. The material for the hydrophobic patch is chosen so that it has a high fluid resistance to fluid flow at the operating pressure of the system but still allow air to pass through. During fluid flush(es) or fluid delivery, substantially no fluid enters the bypass passage from the unfiltered compartment of the inlet chamber, while air in the unfiltered compartment is forced out through the hydrophobic bypass filter 1102 into the bypass passage and the unfiltered side of the outlet chamber.

Figure 12A:
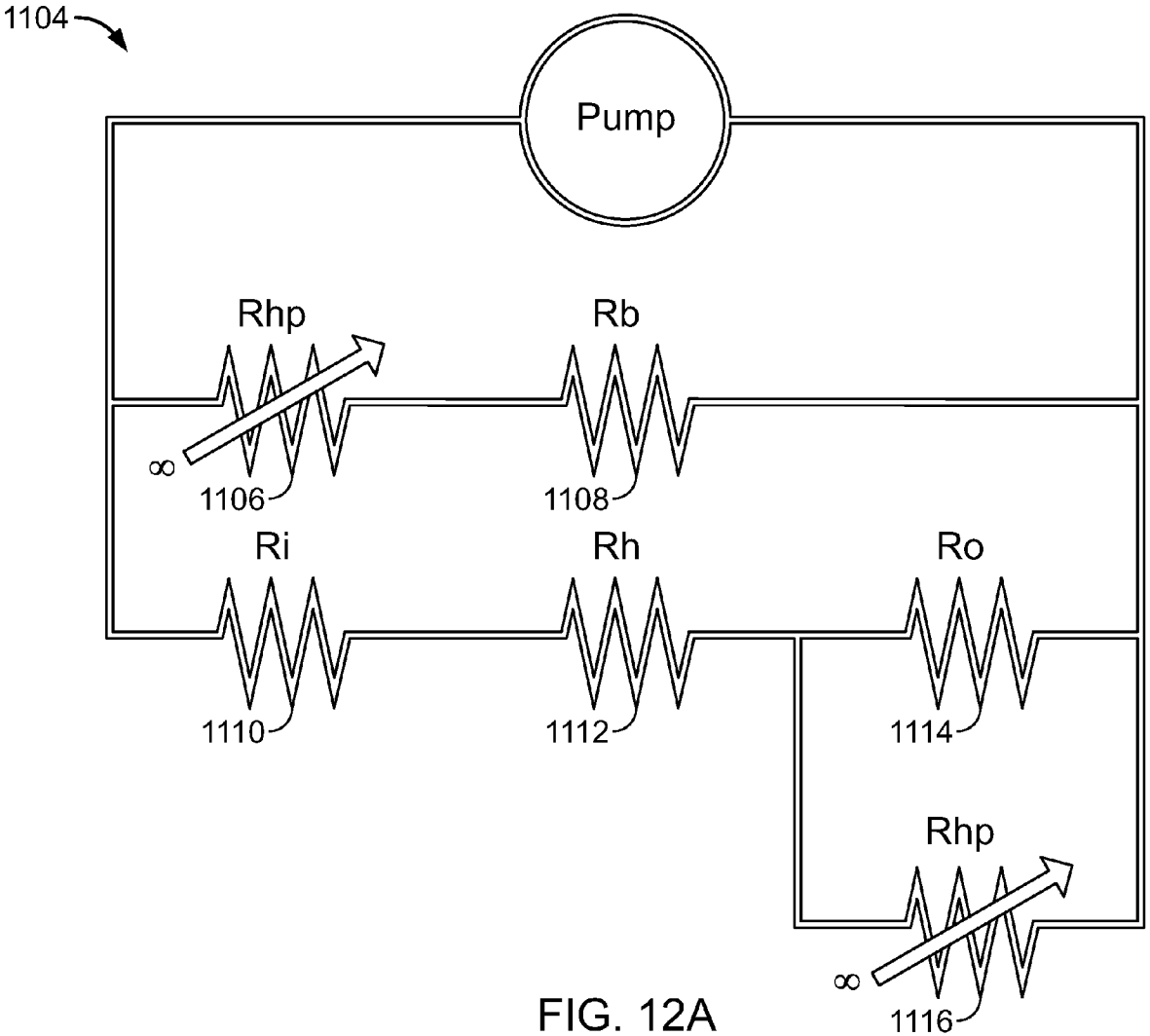
FIG. 12A is a schematic diagram of flow resistance distribution within the fluid ejection assembly of FIG. 12.

Compared to the flow resistance distribution 1004 of FIG. 10A associated with the assembly 1000 of FIG. 10, a flow resistance distribution 1104 shown in FIG. 12A for the fluid flow in the assembly 1100 differs in that an infinite flow resistance Rhp 1106 from the hydrophobic bypass filter is serially connected to the flow resistance Rb 1108 from the bypass passage. Effectively, the fluid flow in the assembly 1100 encounters serially connected resistances Ri 1110 from the inlet filter, Rh 1112 from the die, and Ro 1114 from the outlet filter. The flow resistance Rhp 1116 for the hydrophobic patch is effectively infinite.

In use, substantially all air can be removed from the housing using one fluid flush. In the example shown in FIGS. 13A-13G, when the fluid is flushed from the inlet towards the outlet, air is removed from the unfiltered compartment of the inlet chamber by forcing the air into the bypass passage towards the unfiltered side of the outlet chamber or by forcing the air through the filter of the inlet chamber into the filtered compartment. Substantially no fluid in the unfiltered compartment takes the same bypass route through the bypass passage as the air does due to the impermeability of the hydrophobic bypass filter 1102. When filled with the fluid, substantially no air is trapped in the unfiltered compartment. Downstream of the unfiltered compartment, the air is removed towards the outlet chamber. In particular, the air in the filtered side of the outlet chamber passes through the hydrophobic patch to the unfiltered side, and substantially all air in the unfiltered side exits the outlet. When filled with the fluid (except for in the bypass passage), the assembly 1100 contains substantially no trapped air.

Although symbols such as Ri, Ro, Rh, Rhp, and others are used in FIGS. 4A, 6A, 8A, 10A, and 12A to represent the same type of flow resistance, the values of each type of flow resistance represented by the same symbol may differ in different figures. The values can vary based on the sizes, materials, designs, flow rates, and other features of the respective assemblies. Also, the flow resistance distributions shown in these figures are simplified. There are other flow resistances in the assemblies, for example, the flow resistance through the print head (Rh) includes the resistances of the supply channels, bypass channels, pumping chambers, and bypasses in the interposer; and the flow resistance through the inlet (Ri) includes the resistances of the pipe from the inlet to the filter housing, the filter, and the pipe from the filter to the die.

In some implementations, other assemblies can be formed using different combinations of an outlet filter with an opening, an outlet filter with an opening covered by a hydrophobic patch, an inlet filter with an opening covered by a hydrophobic patch, a bypass passage, and a bypass passage with an opening covered by a hydrophobic patch. For example, an assembly similar to 900 of FIG. 8 can be formed, with an additional hydrophobic patch similar to the hydrophobic patch 1102 of FIG. 12 covering an opening of the bypass passage 902 connected to the unfiltered compartment of the inlet chamber.

The assemblies 500, 700, 800, 900, 1000, and 1100 can be implemented in various suitable forms, e.g., in different shapes, sizes, and etc., and/or using different materials. In some implementations, assemblies that require only one fluid flush to substantially remove all air can have an outlet chamber that does not include an outlet filter. When multiple fluid flushes in different directions are used, the fluid flushes can be done in any desired sequences, e.g., from the inlet towards the outlet or reversely from the outlet towards the inlet. For fluid jetting and recirculation within the dies, the fluid can be delivered from either the inlet towards the outlet or from the outlet towards the inlet.

Figure 14:
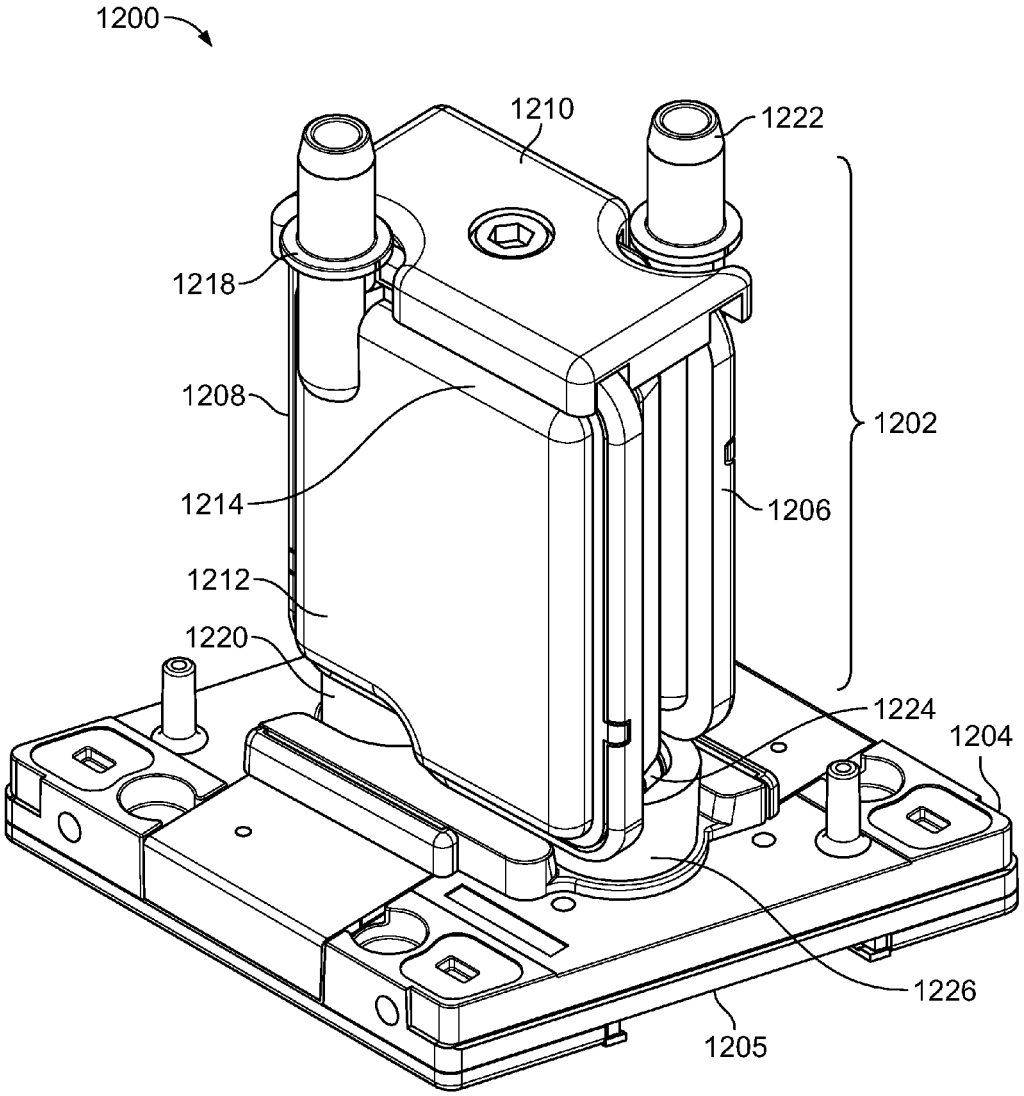
FIG. 14 is a perspective view of a fluid ejection assembly.

In some implementations, the various assemblies discussed above are implemented as an assembly 1200 shown in FIG. 14. The assembly 1200 includes a housing 1202 mounted on a head mount 1204. The housing 1202 and the head mount 1204 have features similar to or the same as the features of the housings and head mounts in the previously discussed assemblies 500, 700, 800, 900, 1000, and 1100. A die having a plurality of fluid ejectors can be mounted to and fluidically connected with the head mount 1204 through a bottom opening 1205.

The housing 1202 contains two independent sub-housings 1206, 1208 secured to each other using a support structure 1210. Each sub-housing 1206, 1208 has a thin box shape, with all corners and edges being curved to prevent the fluid or the air from being trapped at corners (such as a corner 1212) or edges (such as an edge 1214). In some implementations, flat surfaces of the sub-housings 1206, 1208 facing each other are bonded, e.g., using an adhesive.

The sub-housing 1208 houses a fluid inlet chamber similar to or the same as the inlet chambers discussed previously. The sub-housing 1208 also has a fluid inlet 1218 similar to the fluid inlet discussed for any of the assemblies above. The filtered fluid from the sub-housing 1208 is delivered to the fluid pathway(s) in the head mount 1204 from an exit of the sub-housing assembled within a connector 1220 of the head mount 1204. On the other hand, the sub-housing 1206 houses a fluid outlet chamber similar to or the same as the inlet chambers discussed previously. The sub-housing 1206 also has a fluid outlet 1222 similar to the fluid outlet discussed for any of the assemblies above. The recirculated or flushed fluid from the fluid pathway(s) in the head mount 1204 enters the sub-housing 1206 from an entrance 1224 of the sub-housing 1206 assembled within a connector 1226 of the head mount 1204.

Figure 14A:
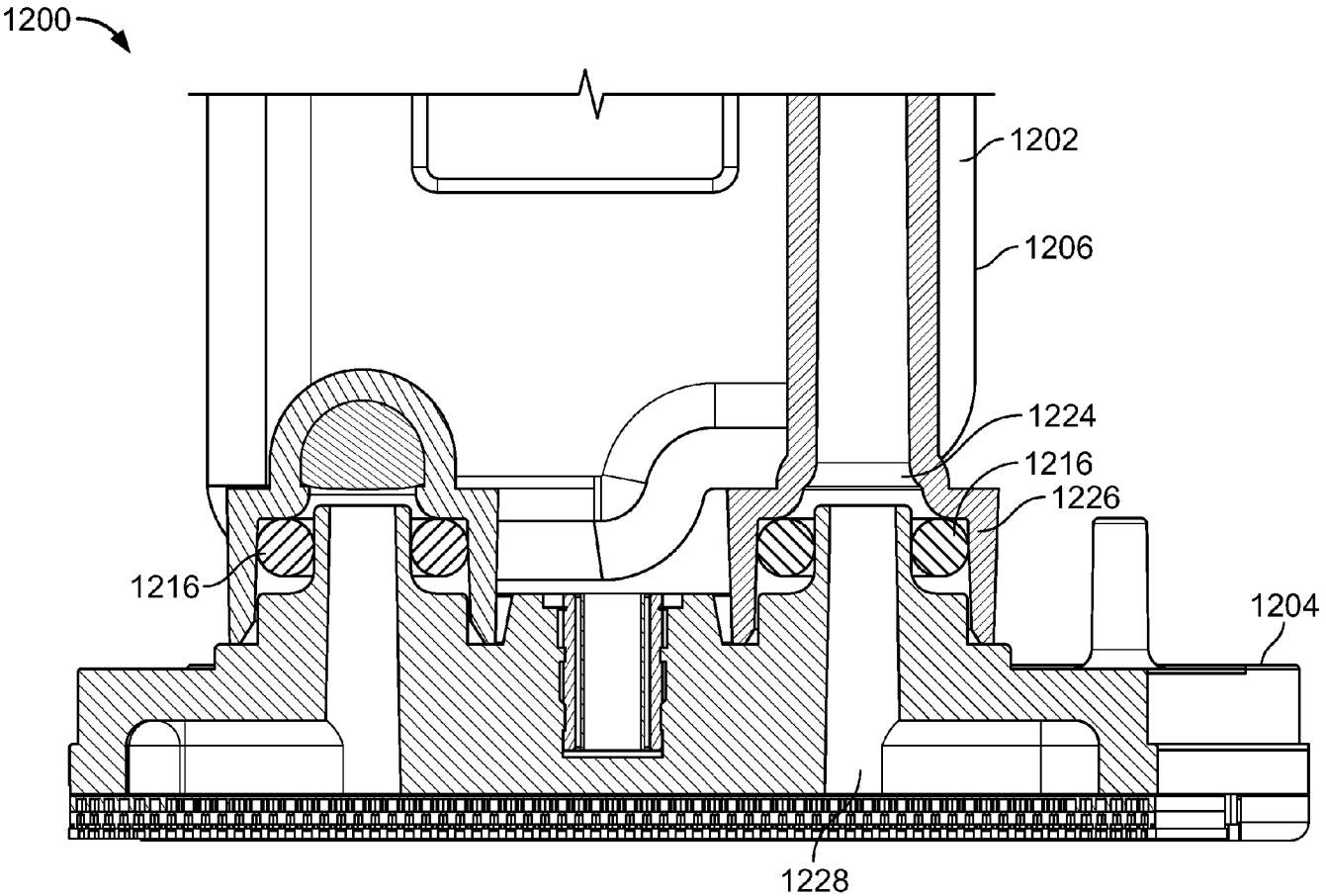
FIG. 14A is a cross-sectional view of a portion of the fluid ejection assembly of FIG. 14.

Referring also to FIG. 14A, O-rings 1216 are used to seal the connection between the housing 1202 and the head mount 1204. In particular, an O-ring 1216 seals the aligned entrance 1224 of the sub-housing 1206 and the fluid pathway(s) 1228 in the connector 1226. Similarly, an O-ring is used for sealing the exit of the sub-housing 1208 to the fluid pathways of the head mount 1204. The alignment and the sealing facilitate fluid flow between the housing 1202 and the head mount 1204 and prevent debris from entering the die 1203.

Figure 14B:
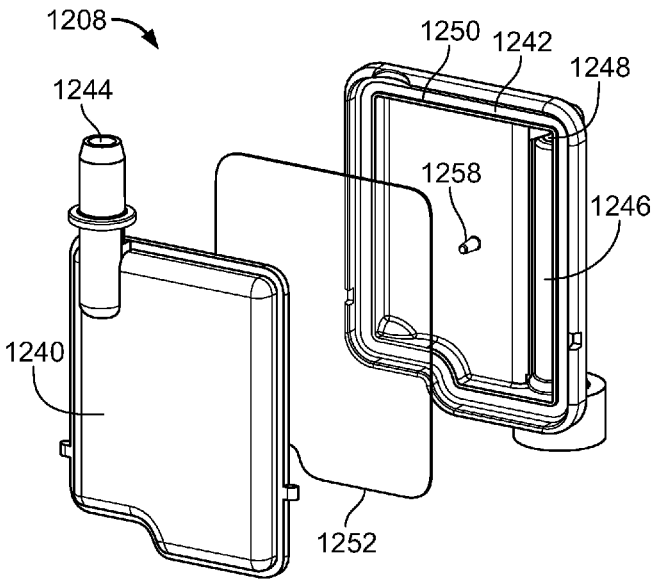
FIGS. 14B and 14D are exploded perspective views of sub-housings forming inlet chamber and outlet chamber of the fluid ejection assembly of FIG. 14.
Figure 14C:
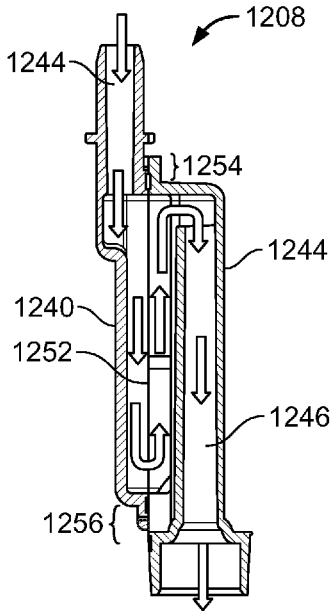
FIGS. 14C and 14E are schematic cross-sectional views of the inlet chamber and the outlet chamber of the fluid ejection assembly of FIG. 14 in use.

Referring to FIGS. 14B-14C, the sub-housing 1208 containing the inlet chamber is formed by assembling an inlet filter 1252 between a front cover 1240 and a back cover 1242. The filter 1252 has a sheet form and can be secured, e.g., glued, between the two covers 1240, 1242 at locations 1254, 1256. As an example, FIG. 14F shows bonding of the filter 1252 to the two covers 1242, 1240. The assembled covers and the filter are sealed using, e.g., epoxy 1253, such that the inlet chamber is sealed from the external environment. Within the inlet chamber, the filter 1252 is supported by a support 1258 attached to or formed integrally with the back cover 1242. The support 1258 extends across the filtered compartment of the inlet chamber and contacts the filter 1252 to help the filter 1252 to maintain its shape and location when fluid is filled into the inlet chamber. An inlet 1244 is attached to or integrally formed with the front cover 1240. The back cover contains a wall 1246 having an opening 1248 near a ceiling 1250 of the back cover 1242, which forms a fluid path the same or similar to those discussed in the previous figures, e.g., the path 528 of FIG. 2.

Figure 14D:
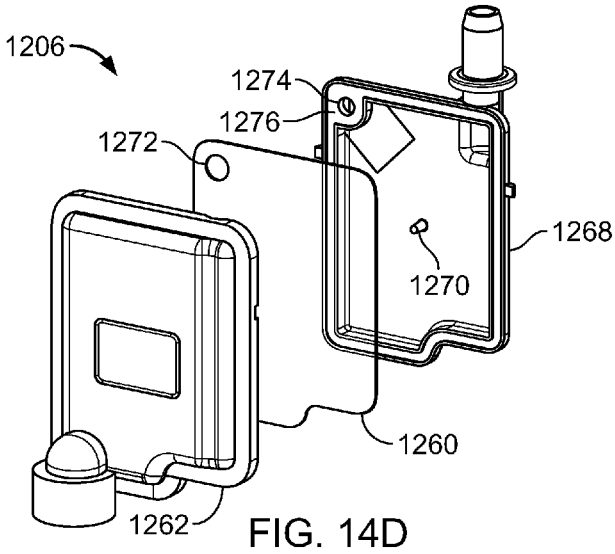
Figure 14E:
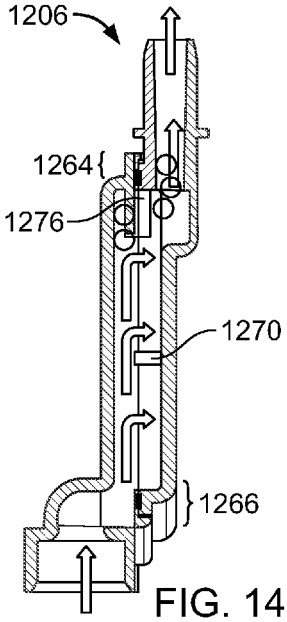
Figure 14F:
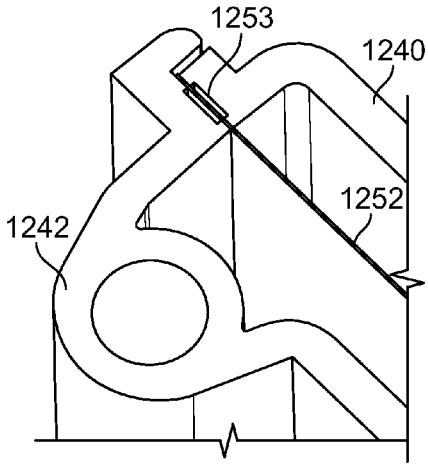
FIG. 14F is a perspective view of a portion of the fluid ejection assembly of FIG. 14.

Referring to FIGS. 14D and 14E, the sub-housing 1206 containing the outlet chamber is formed by assembling an outlet filter 1260 between a front cover 1262 and a back cover 1268. Similar to the inlet filter 1252 bonding shown in FIG. 14F, the outlet filter 1260 is secured between the front cover 1262 and the back cover 1268 at portions 1264, 1266 using, e.g., glues or epoxy. The back cover 1268 can also include a support that extends across the unfiltered side of the outlet chamber to support the filter 1260 in the outlet chamber. The outlet filter 1260 includes an air vent hole 1272 that matches a hole 1274 in the back cover 1268. The surroundings of the air vent hole 1272 is attached to the edge 1276 of the hole 1274 so that the hole 1272 is properly supported and does not distort substantially when air and/or a fluid passes through the hole 1272. The hole 1274 in the back cover 1276 is open to the space in the outlet chamber.

Figure 15:
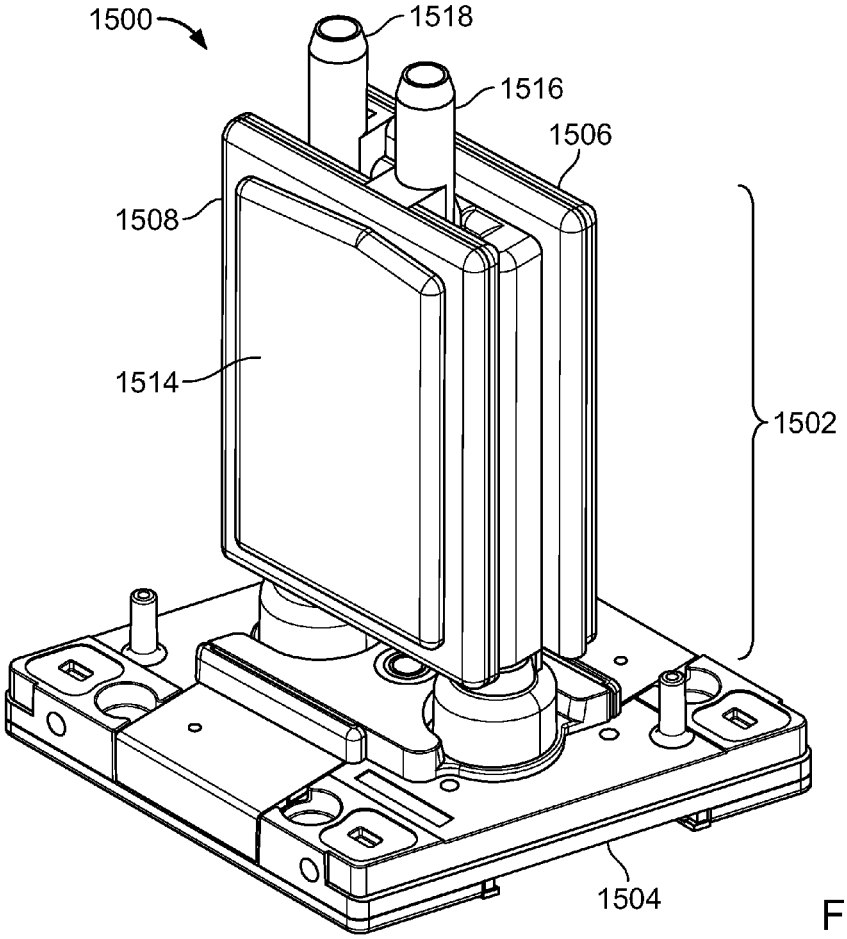
FIG. 15 is a perspective view of another fluid ejection assembly.

In some implementations, one or more previously discussed assemblies 500, 700, 800, 900, 1000, and 1100 can be implemented as an assembly 1500 shown in FIG. 15. The assembly 1500 has many features similar to those of the assembly 1200 of FIG. 14. At least some of the features that are different from those of the assembly 1200 are discussed below. The assembly 1500 is assembled using ultra-sonic welding and has features that facilitate the welding method. In particular, the assembly 1500 includes a housing 1502 mounted on a head mount 1504. The housing 1502 includes two sub-housings 1506, 1508 defining an outlet chamber and an inlet chamber, respectively. Each sub-housing 1506, 1508 includes a flat cover (a flat cover 1514 of the sub-housing 1508 is shown) that allows near-field ultra-sonic welding for assembling the sub-housings. The filter member 1522 is welded to the back cover 1524 along the frame 1528 of the filter 1522. Similarly, the front cover 1520 is welded to the filter member 1522 along the frame 1528. The inlet 1516 and the outlet 1518 of respective sub-housings are arranged close to each other so that openings (not shown) in a print bar to which multiple assemblies are mounted (not shown) is relatively small.

Figure 15A:
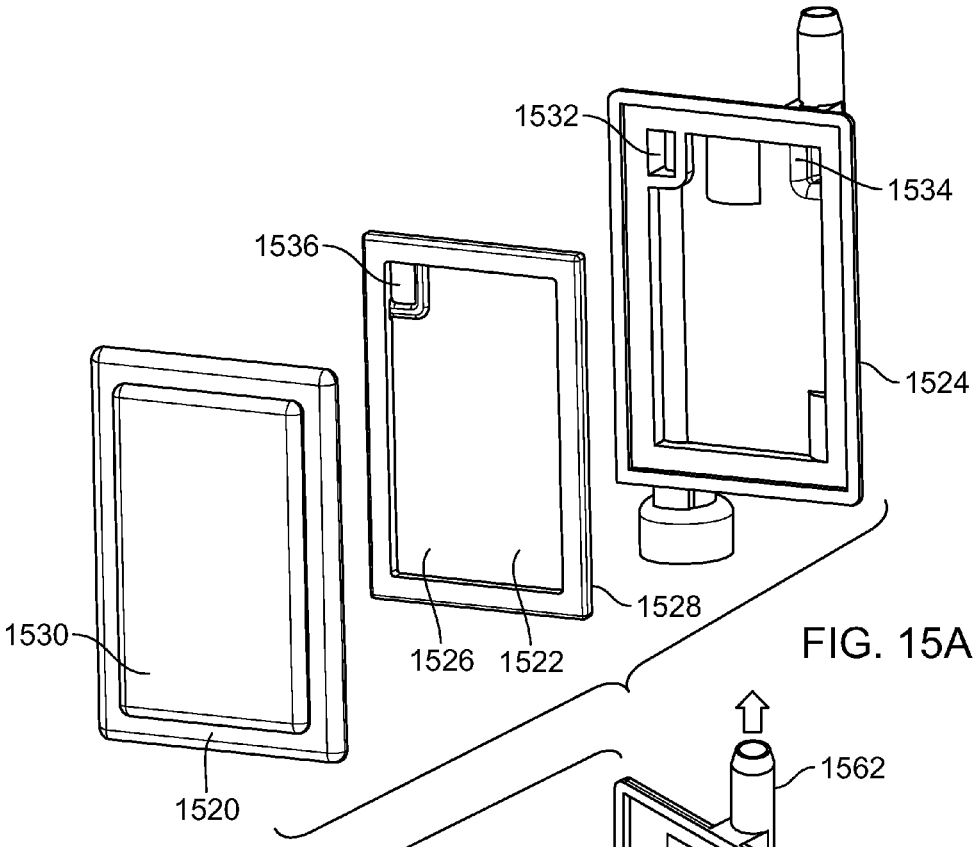
FIGS. 15A and 15B are exploded perspective views of sub-housings forming inlet chamber and outlet chamber of the fluid ejection assembly of FIG. 15.

Referring to FIG. 15A, the sub-housing 1508 of FIG. 15 is formed by ultra-sonically welding a filter member 1522 between a front cover 1520 and a back cover 1524. The filter member 1522 includes a filter 1526 formed, e.g., by insert injection molding, in a frame 1528. The front cover 1520 has a substantially flat surface 1530 to facilitate near-field ultra-sonic welding. The back cover 1524 contains ports 1532, 1534 for fluid delivery. The port 1532 corresponds to a port 1536 of the filter member and the filter member 1522 can be welded to the back cover around ports 1532, 1536. The ultra-sonic welding seals the connections between different parts.

Figure 15B:
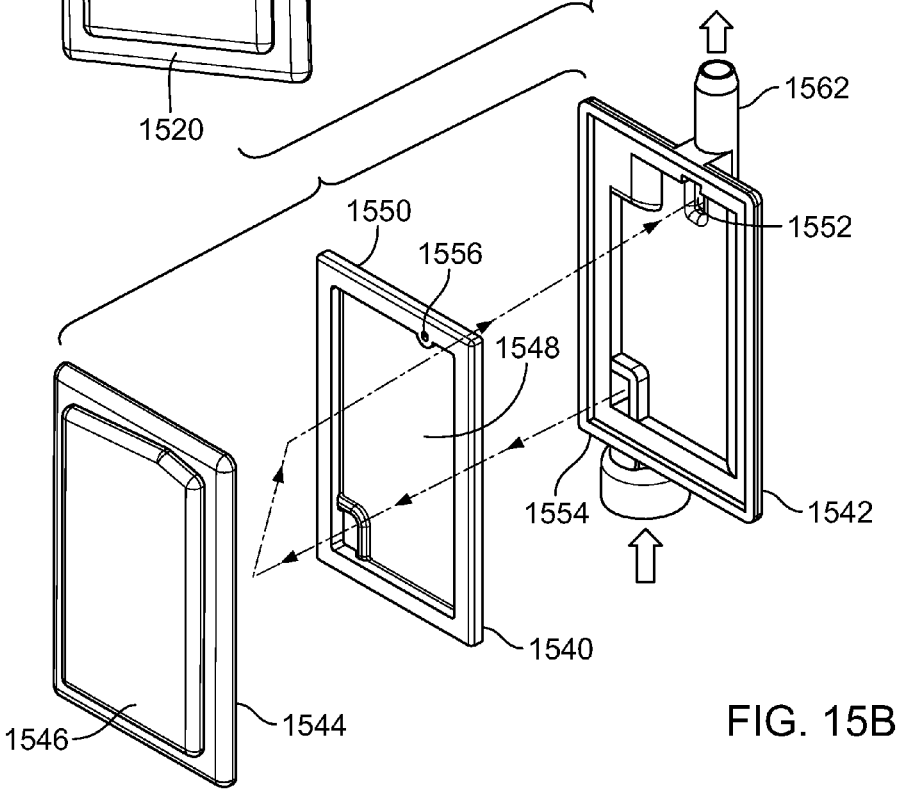
Figure 15C:
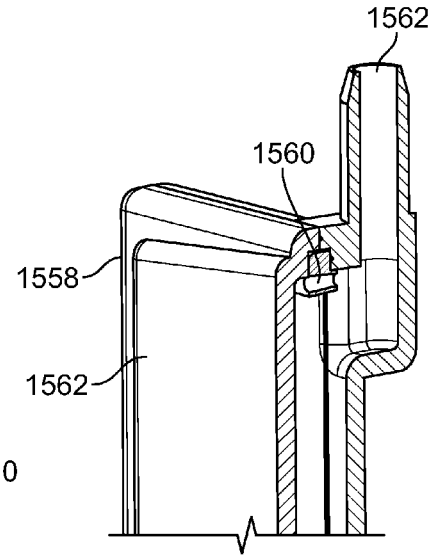
FIG. 15C is a perspective view of a part of a sub-housing forming the outlet chamber of FIG. 15.

Referring to FIGS. 15B and 15C, the sub-housing 1506 of FIG. 15 is formed by welding a filter member 1540 between a front cover 1544 and a back cover 1542. Similar to the filter member 1522 of FIG. 15A, the filter member 1540 also includes a filter 1548 formed, e.g., by insert injection molding, in a frame 1550. The front cover 1544 includes a substantially flat surface 1546 for near-field ultra-sonic welding. The back cover 1542 includes ports 1552, 1554 for welding with the filter member 1540. The filter member 1540 further includes an air vent hole 1556 at the top of the frame 1550. In addition, the back cover 1542 has a sloped ceiling formed by a sloped top 1558 of a substantially flat surface 1562 to funnel possible air bubbles into an air vent hole 1560 towards an outlet 1562.

Figure 16:
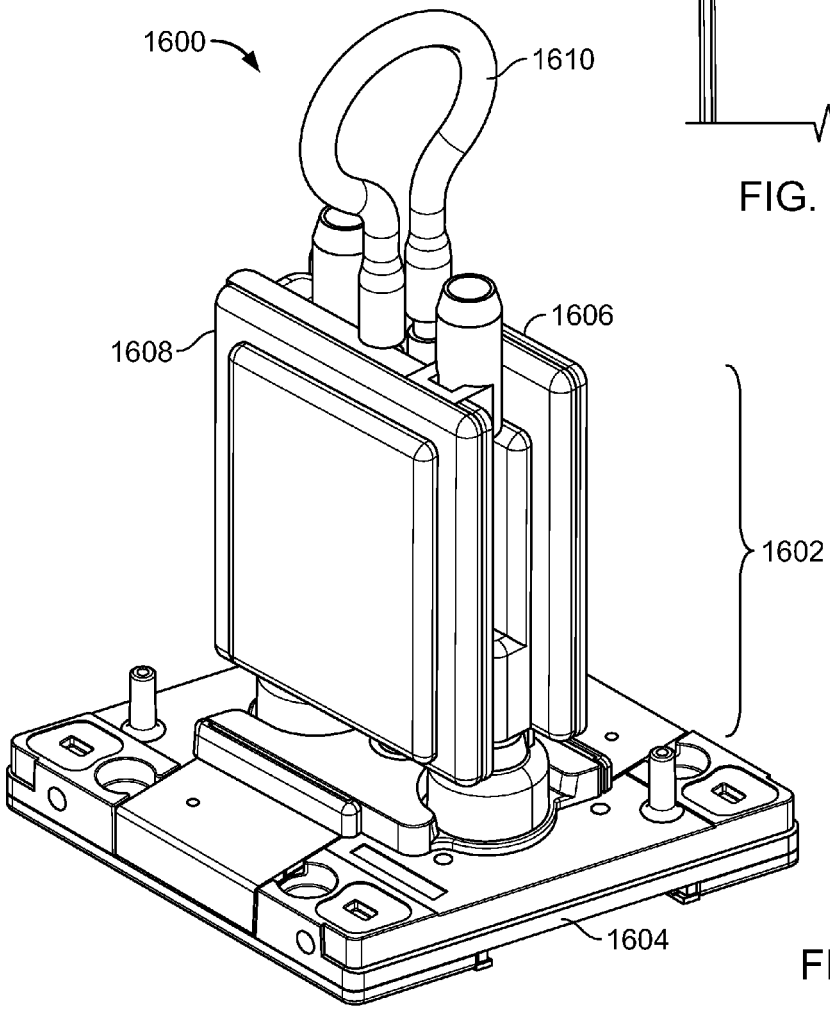
FIG. 16 is a perspective view of another fluid ejection assembly.

In some implementations, one or more previously discussed assemblies 900, 1000, and 1100 can be implemented as an assembly 1600 shown in FIG. 16. The assembly 1600 includes a housing 1602 mounted on a head mount 1604. The housing 1602 includes two sub-housings 1606, 1608 containing an outlet chamber and an inlet chamber, respectively. A bypass tube 1610 fluidically connects the unfiltered compartment of the inlet chamber and the unfiltered side of the outlet chamber.

Figure 16A:
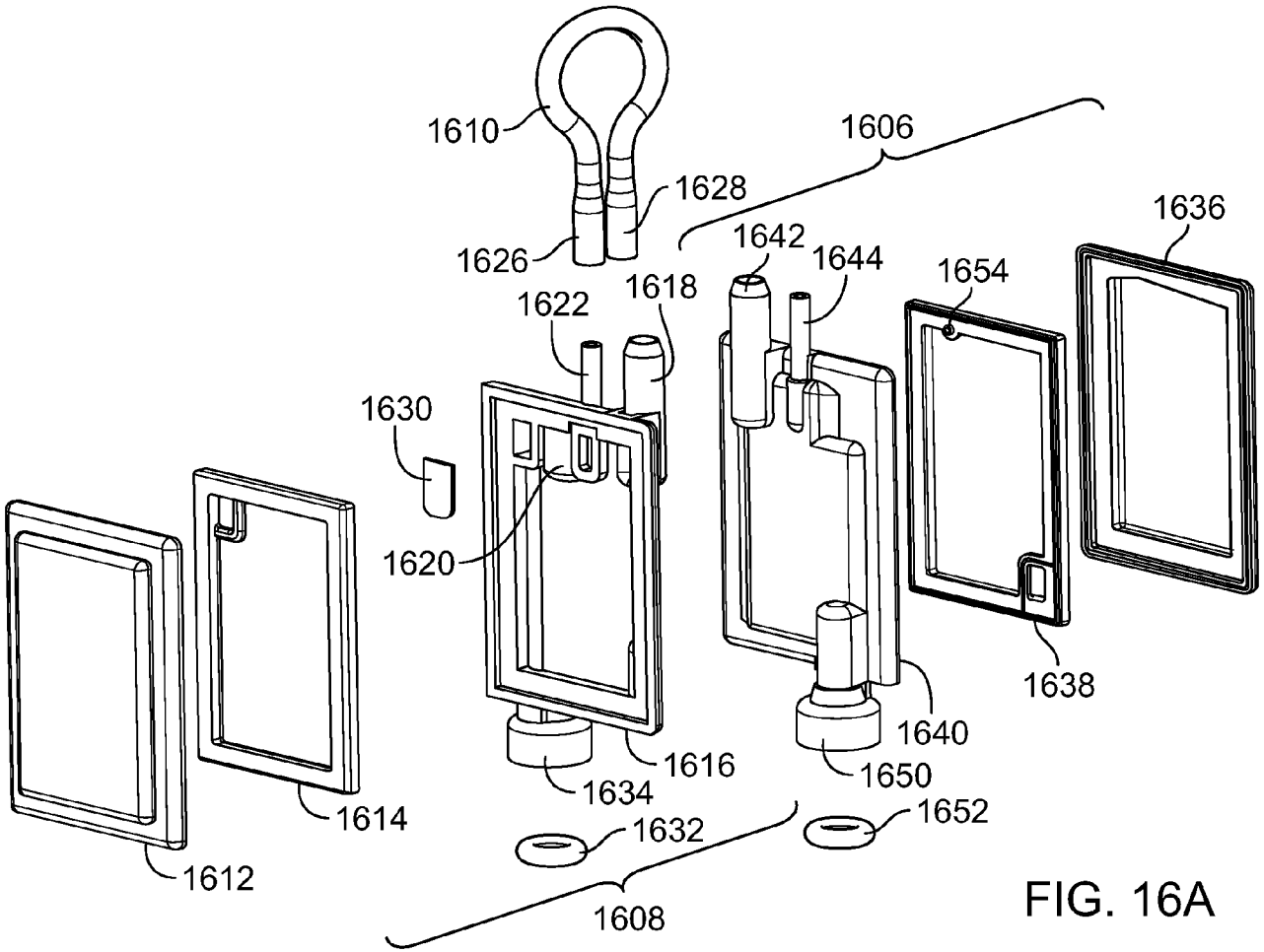
FIGS. 16A and 16B are exploded perspective views of the fluid ejection assembly of FIG. 16.

In particular, referring to FIG. 16A, the sub-housing 1608 has features similar to those of the sub-housing 1508 described in FIG. 15A, including a front cover 1612, a filter member 1614, and a back cover 1616 assembled, e.g., welded, to form the inlet chamber. In addition to the inlet 1618 attached to or formed integrally with the back cover 1616, the back cover also includes an opening 1620 connecting the unfiltered compartment of the inlet chamber to a bypass port 1622, which is configured to receive one end 1626 of the bypass tube 1610. Optionally, a hydrophobic bypass filter 1630 can be applied over the opening 1620 to block fluids from entering the bypass port 1622 and allow only air to pass the opening 1620 into the bypass tube 1610. The assembled or welded sub-housing 1608 can be connected to the head mount 1604 through an outlet 1634 and the connection is sealed by an O-ring 1632.

Figure 16B:
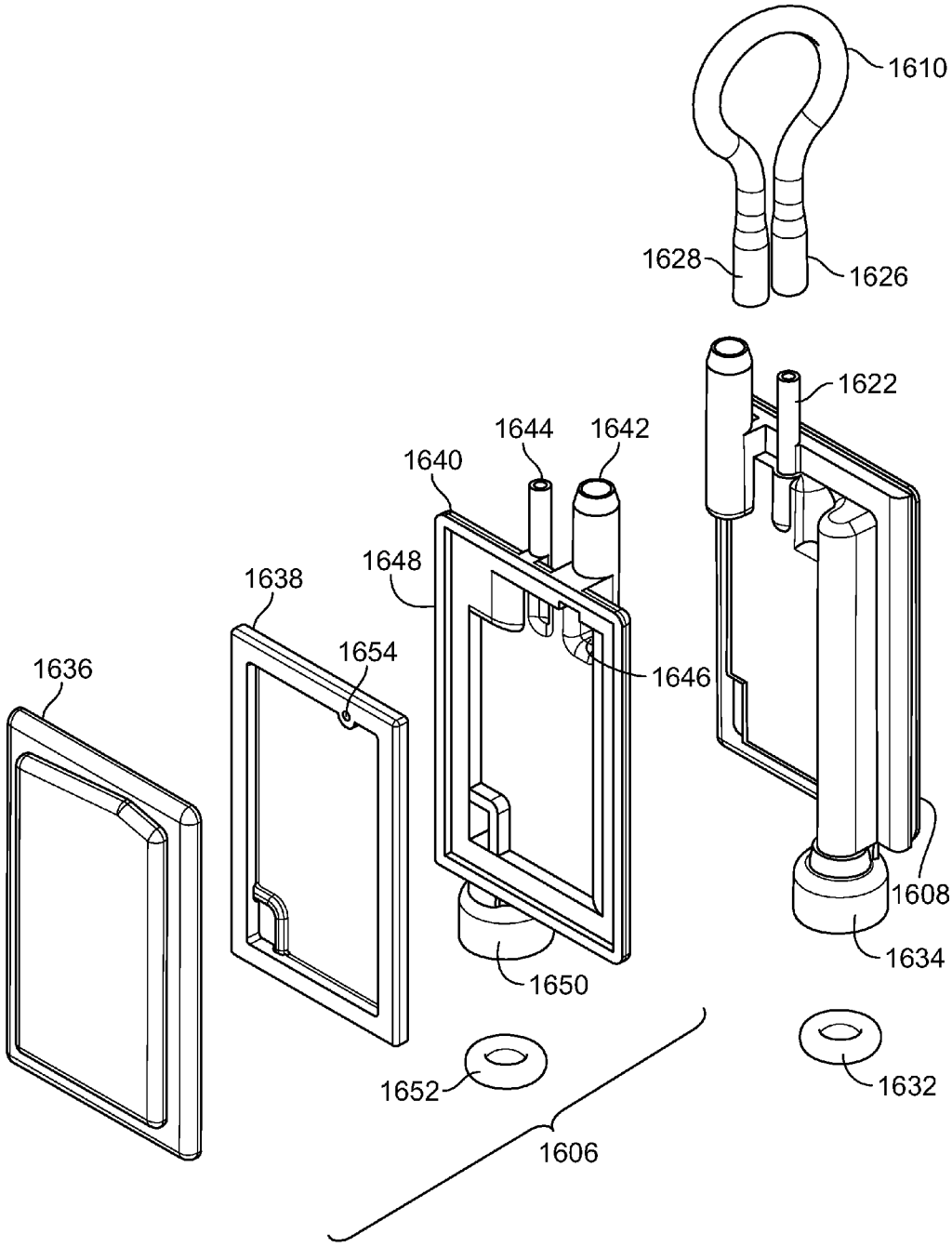

Referring to FIGS. 16A and 16B, the sub-housing 1606 has features and is formed similar to those of the sub-housing 1506 described in FIG. 15B, including a front cover 1636, a filter member 1638, and a back cover 1640 assembled, e.g., welded, to form the outlet chamber. The filter member 1638 includes an air vent hole 1654 the same or similar to the air vent hole 1556 of the filter member 1540 in FIG. 15B. The back cover 1640 includes an opening connected to an outlet 1642. In addition, an opening 1648 is formed in the back cover 1640 and connects to a bypass port 1644, which is configured to connect to another end 1628 of the bypass tube 1610. The assembled or welded sub-housing 1608 can be connected to the head mount 1604 through an outlet 1650 and the connection is sealed by an O-ring 1652.

Figure 17A:
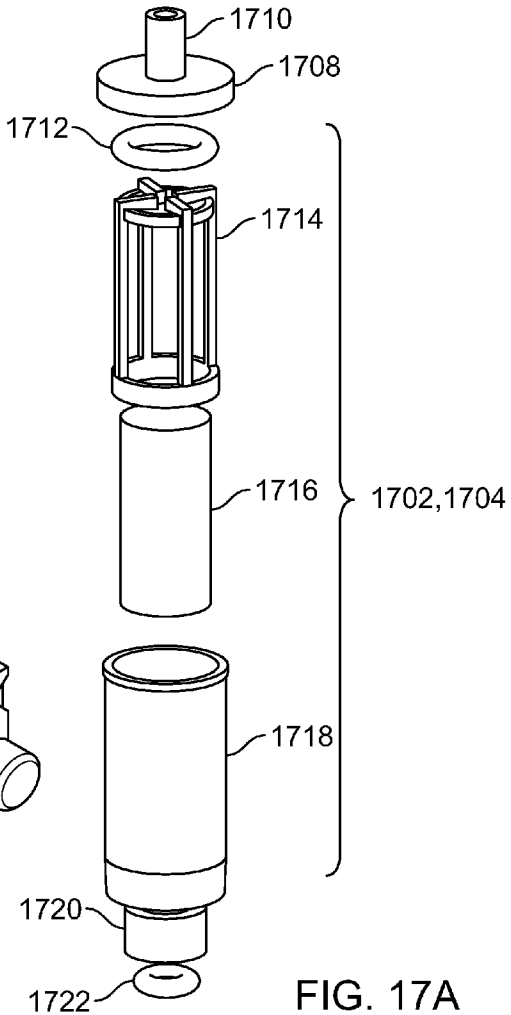
FIGS. 17A and 17B are exploded perspective views of sub-housings forming an inlet chamber and an outlet chamber of the fluid ejection assembly of FIG. 17.
Figure 17:
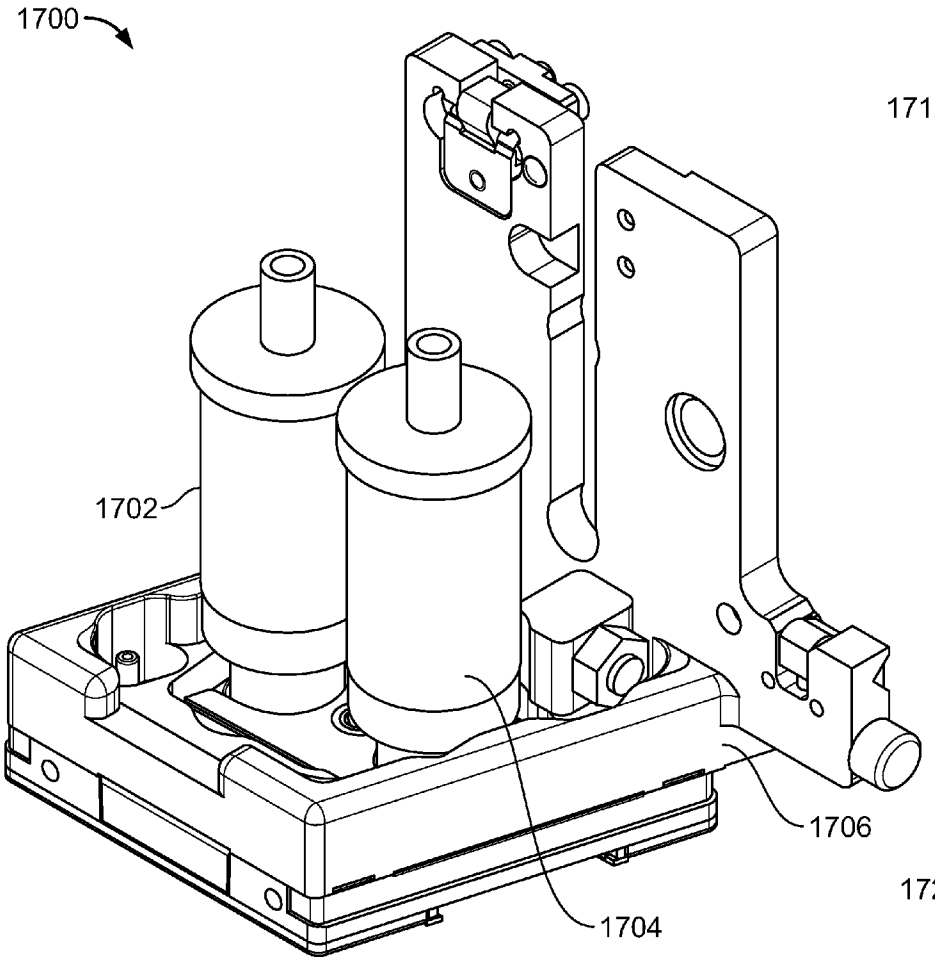
FIG. 17 is a perspective view of another fluid ejection assembly.

Referring to FIGS. 17 and 17A, instead of the previously discussed thin-box-shaped sub-housings and sheet-form filters, an assembly 1700 implementing features and mechanisms discussed for assemblies 500, 700, 800, 900, 1000, and 1100 can include cylindrical sub-housings 1702, 1704 mounted on a head mount 1706. Each sub-housing 1702, 1704 is a snapped assembly that includes a cap 1708 with an inlet or outlet 1710, an O-ring 1712 that seals the cap 1708 to the other parts of the sub-housing, a frame 1714 and a filter 1716 insert injection molded into the frame, a cylindrical shell 1718 to house the inlet or outlet chamber and the filter 1716, and an outlet 1720 to fluidically connect the inlet or outlet chamber to the head mount 1706. The connection is sealed by an O-ring 1722.

FIGS. 17B, 17C, and 17E show details of the sub-housing 1702 forming the inlet chamber. The cap 1708 and the shell 1718 has mating features 1724, 1726, respectively for snap fitting the two parts as shown in FIGS. 17C and 17E. The O-ring 1712 sits inside the shell 1726 and pushes the mating features 1724, 1726 against each other to seal the connection. The frame 1714 tapers from a ceiling 1734 towards a bottom 1736. In particular, the top of the frame 1714 has a diameter smaller than a diameter of the shell 1726, and the outer surface of the bottom 1736 has the same diameter as or slightly larger diameter than the inner surface of the shell 1726. When assembled, the bottom 1736 is press fit to the shell 1726 and the contact between the outer surface of the bottom 1736 and the inner surface of the shell 1726 is sealed so that fluids cannot pass between the surfaces. The filter 1716 can have a cylinder-like shape and can follow the shape of the frame 1714 to taper similarly as the frame 1714.

The ceiling 1734 of the frame is impermeable to fluids. When assembled, the filter 1716 and the ceiling 1734 separate the inlet chamber into an inner, filtered compartment 1730 and an outer, unfiltered compartment 1732 surrounding the inner filtered compartment 1730. Fluids from the inlet 1710 enter the outer, unfiltered compartment 1732 first, and enter the inner filtered compartment 1730 only through the filter 1716. In the example shown in FIGS. 17C and 17D, the ceiling 1734 is sloped from the edge down towards the center, e.g., for reducing air entrapment. Within the inner, filtered compartment 1730, a wall 1734 similar to the wall 526 of FIG. 2 and the wall 1246 of FIG. 14B extends towards the ceiling 1734 and forms a fluid path connected to the outlet 1720 of the sub-housing. The filtered fluid exits the filtered compartment 1730 through the channel formed in the wall 1734, while removing air from the filtered compartment 1730.

Referring to FIG. 17D, the structure of the sub-housing 1704 for the outlet chamber is substantially the same as that of the sub-housing 1702, except that there is no additional wall, such as the wall 1734 of FIG. 17C, within the shell 1718. In addition, the ceiling 1734 contains an air vent hole fluidically connecting the filtered side and the unfiltered side of the outlet chamber.

Figure 17F:
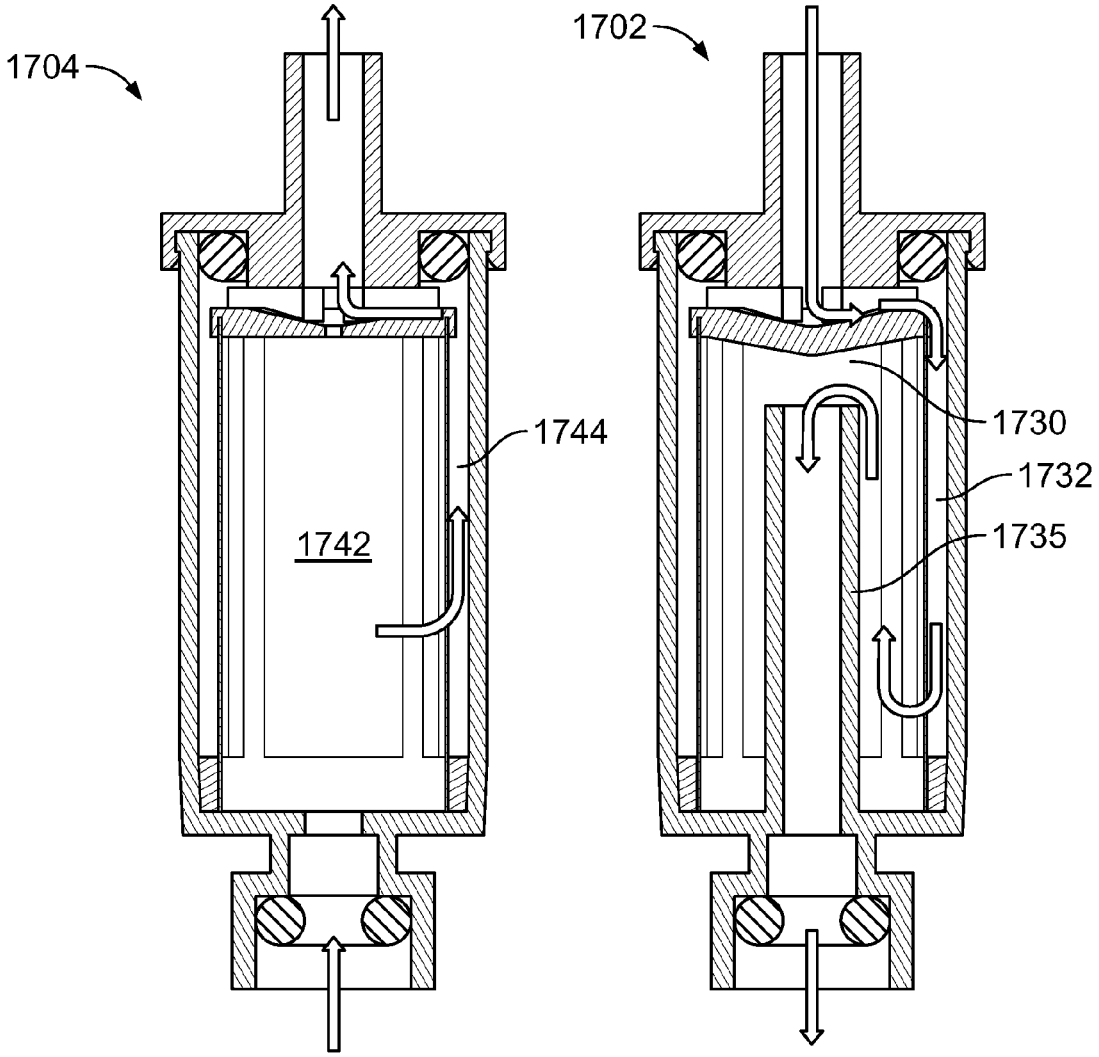
FIGS. 17C, 17D, and 17E are perspective cross-sectional views of parts of or an entire sub-housing of FIG. 17.
Figures 18, 18A, 18B, 18C:
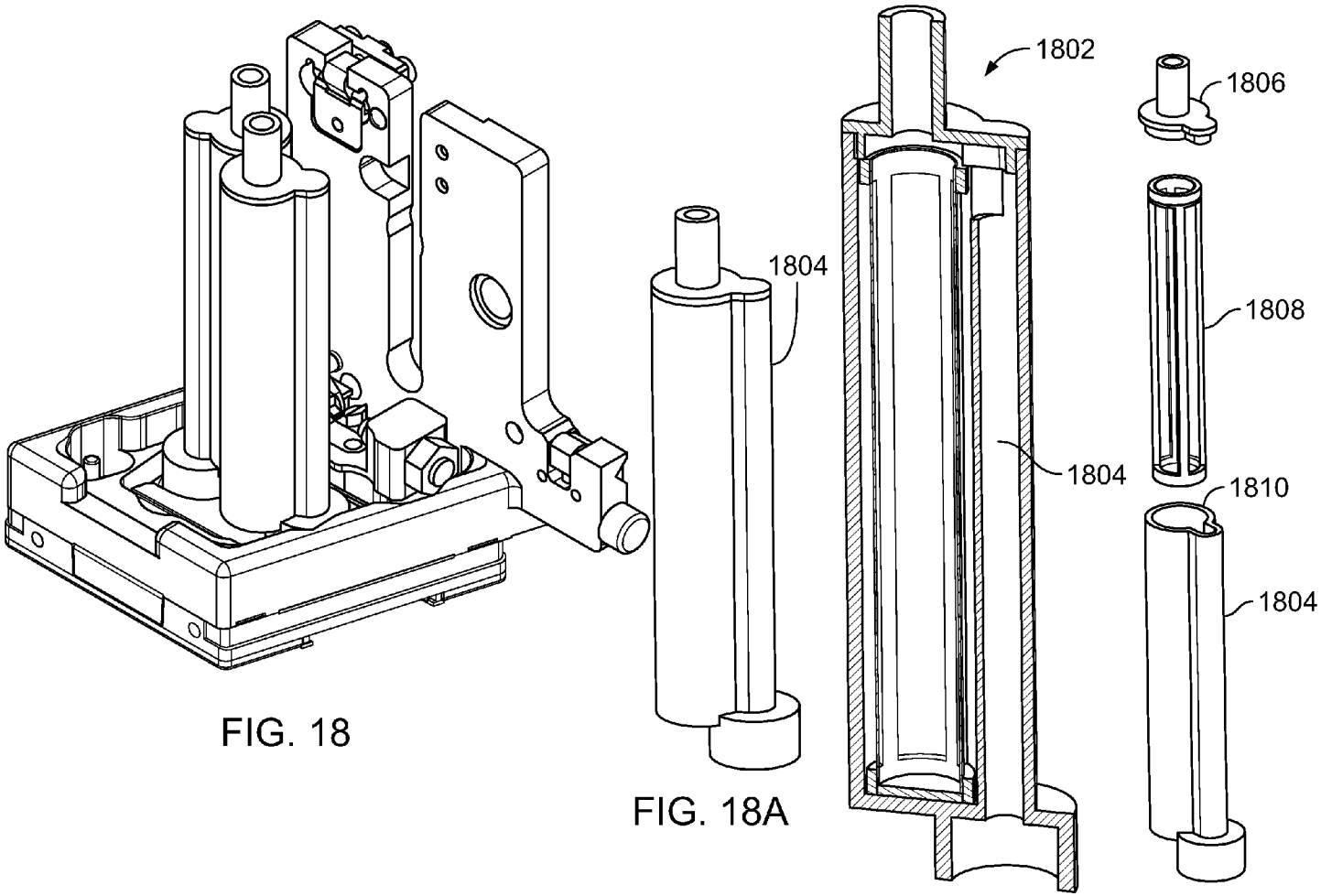
FIG. 18 is a perspective view of another fluid ejection assembly.
FIGS. 18A, 18B, and 18C are perspective view, exploded perspective view, and cross-sectional view of a sub-housing of the fluid ejection assembly of FIG. 18.

In use, the fluid flow from the sub-housing 1702 to the sub-housing 1704 is shown in FIG. 17F. In particular, as shown by the arrows in the figure, the fluid enters the unfiltered compartment 1732, passes through the filter into the filtered compartment 1730, and further through the channel within the wall 1735 to exit the sub-housing 1702. The fluid in the sub-housing 1704 passes from an unfiltered inner side 1742 to a filtered outer side 1744 to exit the sub-housing 1704. The fluid can also flow reversely in the two sub-housings.

The detailed features of cylindrical sub-housings 1702, 1704 can be altered to serve the desired purposes. For example, as shown in FIGS. 18 and 18A-18C, a sub-housing 1802 for an inlet/outlet chamber can have an offset port 1804. Instead of snap fitting, the sub-housing 1802 is formed by welding a cap 1806, a filter member 1808, and a shell 1810. Other alterations are possible too.

Figure 19:
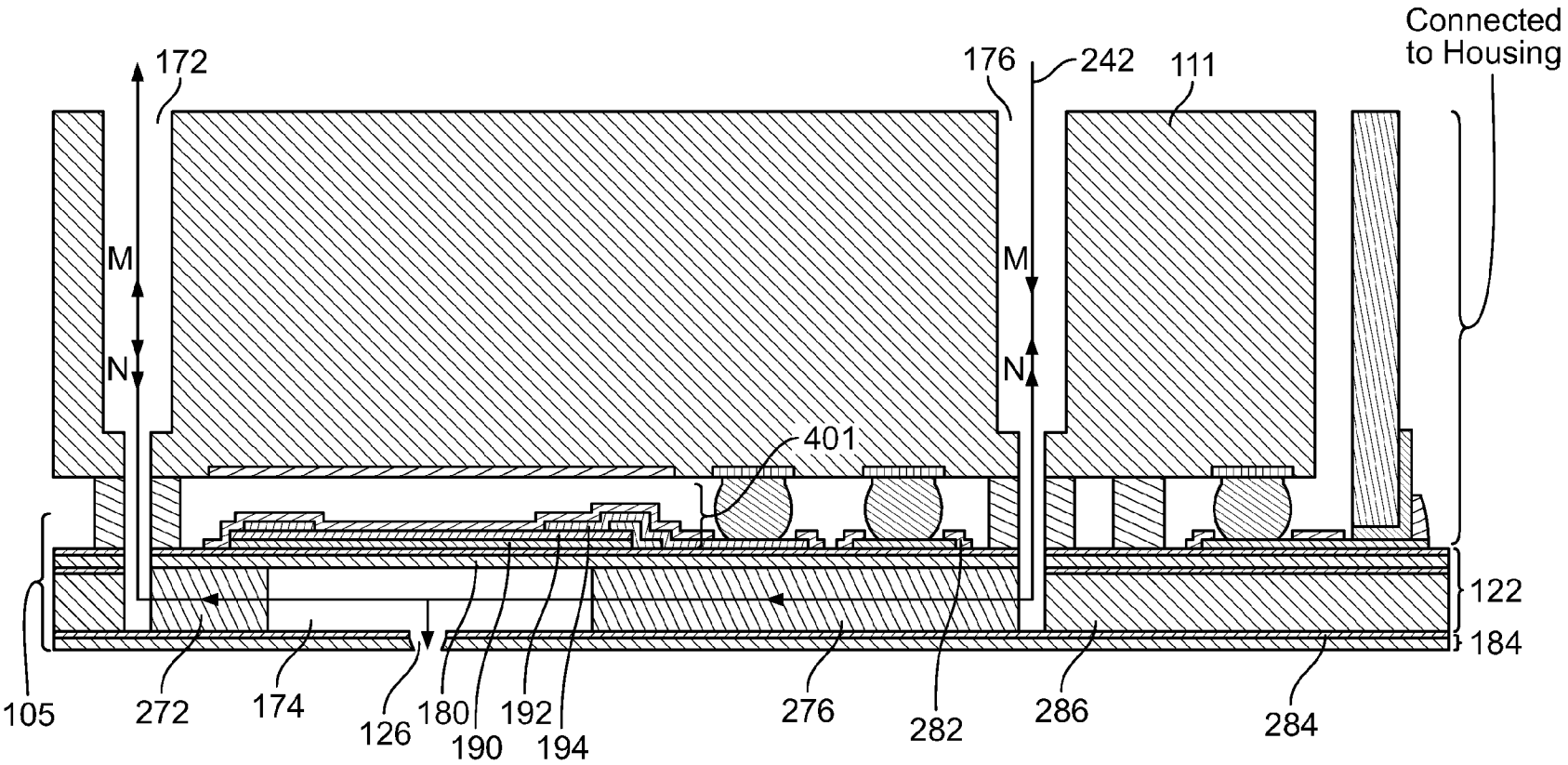
FIG. 19 is a cross-sectional view of a portion of a die connected to a housing.

The die, such as those in the assemblies 500, 700, 800, 900, 1000, and 1100 and assemblies 1200, 1500, 1700, 1800, can have different forms. In the example shown in FIG. 19, a die 105 includes a substrate 122, e.g., a silicon-on- insulator (SOI) wafer and the integrated circuit interposer 111. Within the substrate 122, fluid paths 242 are formed to recirculate the fluid along the M direction (single arrow) or along the N direction (double arrow) between an inlet 176 and an outlet 172 while delivering the fluid to a pumping chamber 174 to be jetted from a nozzle 126. The inlet 176 and the outlet 172 can be connected to the inlet chamber and the outlet chamber of the previously discussed assemblies.

In the example shown in the figure, the pumping chamber 174 is part of the flow path 242. Each fluid path 242 includes the inlet channel 176 leading to the pumping chamber 174, and further to both the nozzle 126 and the outlet channel 172. The fluid path 242 further includes a pumping chamber inlet 276 and a pumping chamber outlet 272 that connect the pumping chamber 174 to the inlet channel 176 and outlet channel 172, respectively.

The fluid path can be formed by semiconductor processing techniques, e.g., etching. In some implementations, deep reactive ion etching is used to form straight walled features that extend part way or all the way through a layer in the die 105. In some implementations, a silicon layer 286 adjacent to an insulating layer 284 is etched entirely through using the insulating layer as an etch stop. The pumping chamber 174 is sealed by a membrane 180 and can be actuated by an actuator formed on the surface of the membrane 180 opposite to the pumping chamber 174. The nozzle 126 is formed in a nozzle layer 184, which is on an opposite side of the pumping chamber 174 from the membrane 180. The membrane 180 can be formed of a single layer of silicon. Alternatively, the membrane 180 can include one or more layers of oxide or can be formed of aluminum oxide ($AlO_2$), nitride, or zirconium oxide ($ZrO_2$).

The actuators can be individually controllable actuators 401 supported by the substrate 122. Multiple actuators 401 are considered to form an actuator layer, where the actuators can be electrically and physically separated from one another but part of a layer, nonetheless. The substrate 122 includes an optional layer of insulating material 282, such as oxide, between the actuators and the membrane 180. When activated, the actuator causes the fluid to be selectively ejected from the nozzles 126 of corresponding fluid paths 242. Each flow path 242 with its associated actuator 401 provides an individually controllable MEMS fluid ejector unit. In some implementations, activation of the actuator 401 causes the membrane 180 to deflect into the pumping chamber 174, reducing the volume of the pumping chamber 174 and forcing fluid out of the nozzle 126. The actuator 401 can be a piezoelectric actuator and can include a lower electrode 190, a piezoelectric layer 192, and an upper electrode 194. Alternatively, the fluid ejection element can be a heating element.

In use, filtered fluids from the previously discussed housings can flow along the flow direction M or the reverse flow direction N within the die without trapping air along the pathway and without carrying a substantial amount of debris or other undesirable materials. During fluid ejection, the filtered fluid from a housing connected to the die 105, is recirculated within the flow path 242 along either direction N, M, while a portion of the recirculated fluid is jetted from the nozzles 126. As previously explained, the flow rate of the fluid in the flow path 242 for the recirculation is substantially higher than, e.g., 2-4 times, the ejection rate of the fluid from the nozzles 126.

Other types of dies can also be used in the assemblies discussed above. Printhead modules are discussed in U.S. Patent Application Publication No. 2011/0007117, the entire content of which is incorporated herein by reference. Fluid recirculation is also discussed in U.S. patent application Ser. No. 13/022,063, the entire content of which is incorporated herein by reference.

Other embodiments are in the scope of the following claims.

What is claimed is:

1. A device for use in printing, the device comprising:

a first chamber for receiving a fluid;

a first filter member in the first chamber, the first filter member separating the first chamber into a first part and a second part laterally adjacent to the first part, the first filter member comprising pores having an average size, the pores configured to filter the fluid passing from the first part to the second part, the first filter member further comprising an opening adjacent to a top of the first chamber for air to pass from the first part to the second part, the opening having a size at least 10 times larger than the average size of the pores;

a first inlet in fluid communication with the first part;

a first outlet in fluid communication with the second part;

a second chamber for receiving the fluid;

a second filter member in the second chamber, the second filter member separating the second chamber into a first part and a second part laterally adjacent to the first part, the second filter member being configured such that substantially all fluid that enters the second part from the first part passes the second filter member;

a second inlet in fluid communication with the first part of the second chamber;

a second outlet in fluid communication with the second part of the second chamber; and a die comprising pumping chambers, the pumping chambers configured to receive the fluid from the second outlet;

wherein the first chamber is downstream of the pumping chambers of the die.

2. The device of claim 1, wherein the average size of the pores is about 2 microns to about 10 microns and the opening has a size larger than 10 microns.

3. The device of claim 2, wherein the opening has a size of about 500 microns to about 1000 microns.

4. The device of claim 1, wherein the first filter member is arranged vertically within the first chamber.

5. The device of claim 1, wherein the opening is covered by a hydrophobic patch that is permeable to air and impermeable to the fluid.

6. The device of claim 1, wherein the second filter member is arranged vertically in the second chamber.

7. The device of claim 1, wherein the second part of the second chamber and the second outlet are configured such that the second part of the second chamber is filled with the fluid before the fluid exits the second chamber from the second outlet.

8. The device of claim 7, wherein the second part of the second chamber contains a wall extending towards a top of the second chamber with a gap between the top of the second chamber and a top of the wall, the wall defining a fluid channel in communication with the second outlet.

9. The device of claim 1, wherein the second filter member comprises pores having an average size of about 2 microns to about 10 microns.

10. The device of claim 1, wherein a surface of the first filter member facing the first part of the first chamber is hydrophobic.

11. The device of claim 1, wherein a surface of the second filter member facing the first part of the second chamber is hydrophobic.

12. The device of claim 9, wherein the second filter member comprises an opening adjacent to a top of the second chamber, the opening in the second filter member having a size larger than 10 microns and being covered by a hydrophobic patch, the hydrophobic patch being permeable to air and impermeable to the fluid.

13. The device of claim 1, further comprising a fluid pathway between the second part of the first chamber and the first part of the second chamber.

14. The device of claim 13, wherein the fluid pathway comprises a bypass tube.

15. The device of claim 13, further comprising a hydrophobic patch covering the opening in the first filter.

16. The device of claim 15, further comprising another hydrophobic patch covering a connection between the first part of the second chamber and the fluid pathway, the hydrophobic patch being permeable to air and impermeable to the fluid.

17. The device of claim 13, further comprising a hydrophobic patch covering a connection between the first part of the second chamber and the fluid pathway, the hydrophobic patch being permeable to air and impermeable to the fluid.

18. The device of claim 1, further comprising a printhead in communication with the first and second chambers.

19. The device of claim 18, wherein the first and second chambers are in indirect fluid communication through the printhead.

20. A method of making the device of claim 1, comprising securing the first filter member between a front cover and a back cover, wherein the front cover and the back cover are sealed to each other to form the first chamber.

21. The method of claim 20, wherein securing the first filter member comprises bonding the first filter member between the front and back covers.

22. The method of claim 20, wherein securing the first filter member comprises ultra-sonically welding the first filter member, the front cover, and the back cover.

* * * * *